US008901845B2

(12) United States Patent
Pickard et al.

(10) Patent No.: US 8,901,845 B2
(45) Date of Patent: Dec. 2, 2014

(54) TEMPERATURE RESPONSIVE CONTROL FOR LIGHTING APPARATUS INCLUDING LIGHT EMITTING DEVICES PROVIDING DIFFERENT CHROMATICITIES AND RELATED METHODS

(75) Inventors: Paul K. Pickard, Morrisville, NC (US); Joseph P. Chobot, Morrisville, NC (US); Mark D. Edmond, Raleigh, NC (US)

(73) Assignee: Cree, Inc., Durham, NC (US)

( * ) Notice: Subject to any disclaimer, the term of this patent is extended or adjusted under 35 U.S.C. 154(b) by 465 days.

(21) Appl. No.: 13/100,385

(22) Filed: May 4, 2011

(65) Prior Publication Data

US 2012/0280621 A1 Nov. 8, 2012

Related U.S. Application Data

(63) Continuation-in-part of application No. 12/704,730, filed on Feb. 12, 2010, which is a continuation-in-part of application No. 12/566,195, filed on Sep. 24, 2009.

(60) Provisional application No. 61/294,958, filed on Jan. 14, 2010, provisional application No. 61/293,300, filed on Jan. 8, 2010.

(51) Int. Cl.
*H05B 37/02* (2006.01)
*H05B 33/08* (2006.01)

(52) U.S. Cl.
CPC ..... *H05B 33/0866* (2013.01)
USPC ..... 315/291; 315/158; 315/307; 315/309; 315/501

(58) Field of Classification Search
USPC ..... 315/149–159, 291, 224, 307, 316, 312; 362/612, 555, 231, 230, 97, 561
See application file for complete search history.

(56) References Cited

U.S. PATENT DOCUMENTS 446,142 A 2/1891 Martin
D188,916 S 9/1960 Harling
(Continued)

FOREIGN PATENT DOCUMENTS

EP 1 020 935 A2 7/2000
EP 1 881 259 A1 1/2008
(Continued)

OTHER PUBLICATIONS

U.S. Appl. No. 12/328,144, filed Dec. 4, 2008, Chobot.
(Continued)

*Primary Examiner* — Thienvu Tran
*Assistant Examiner* — Christopher Lo
(74) *Attorney, Agent, or Firm* — Myers Bigel Sibley & Sajovec, P.A.

(57) ABSTRACT

A lighting apparatus may include a plurality of light emitting devices, a temperature sensor, and a compensation circuit. The plurality of light emitting devices may include a first light emitting device configured to emit light having a first chromaticity, a second light emitting device configured to emit light having a second chromaticity different than the first chromaticity, and a third light emitting device configured to emit light having the second chromaticity. Moreover, the first, second, and third light emitting devices may be electrically coupled in series. The temperature sensor may be configured to generate a temperature sense signal responsive to heat generated by at least one of the plurality of light emitting devices. The compensation circuit may be coupled to the third light emitting device, with the compensation circuit being configured to vary a level of electrical current through the third light emitting device relative to the electrical current through the first and second light emitting devices responsive to the temperature sense signal. Related methods are also discussed.

32 Claims, 9 Drawing Sheets

(56) References Cited

U.S. PATENT DOCUMENTS

| | | | |
|---|---|---|---|
| D207,867 | S | 6/1967 | Pettengill |
| 3,560,728 | A | 2/1971 | Atkin |
| 3,638,042 | A | 1/1972 | Studtmann |
| 3,655,988 | A | 4/1972 | Nakamura et al. |
| 3,755,697 | A | 8/1973 | Miller |
| 3,787,752 | A | 1/1974 | Delay |
| 3,913,098 | A | 10/1975 | Nakamura et al. |
| 4,090,189 | A | 5/1978 | Fisler |
| 4,504,776 | A | 3/1985 | Haville |
| 4,717,868 | A | 1/1988 | Peterson |
| 4,798,983 | A | 1/1989 | Mori |
| 4,839,535 | A | 6/1989 | Miller |
| 4,841,422 | A | 6/1989 | Groh |
| 4,918,487 | A | 4/1990 | Coulter, Jr. |
| 5,059,788 | A | 10/1991 | Tashiro et al. |
| 5,059,890 | A | 10/1991 | Yoshikawa et al. |
| 5,125,675 | A | 6/1992 | Engelbrecht |
| 5,138,541 | A | 8/1992 | Kano |
| 5,151,679 | A | 9/1992 | Dimmick |
| 5,175,528 | A | 12/1992 | Choi et al. |
| 5,334,916 | A | 8/1994 | Noguchi |
| 5,345,167 | A | 9/1994 | Hasegawa et al. |
| 5,357,120 | A | 10/1994 | Mori |
| 5,397,938 | A | 3/1995 | Wilhelm et al. |
| 5,467,049 | A | 11/1995 | Kida et al. |
| 5,504,448 | A | 4/1996 | Bennett et al. |
| 5,528,467 | A | 6/1996 | Jiang |
| 5,598,068 | A | 1/1997 | Shirai |
| 5,631,190 | A | 5/1997 | Negley |
| 5,646,760 | A | 7/1997 | Kuijk et al. |
| 5,661,645 | A | 8/1997 | Hochstein |
| D384,430 | S | 9/1997 | Lecluze |
| 5,736,881 | A | 4/1998 | Ortiz |
| 5,798,520 | A | 8/1998 | Kuijk et al. |
| 5,803,579 | A | 9/1998 | Turnbull et al. |
| D400,280 | S | 10/1998 | Leen |
| 5,844,377 | A | 12/1998 | Anderson et al. |
| 5,912,477 | A | 6/1999 | Negley |
| 5,912,568 | A | 6/1999 | Kiley |
| 5,929,568 | A | 7/1999 | Eggers |
| D418,620 | S | 1/2000 | Grossman |
| D425,024 | S | 5/2000 | Klaus et al. |
| 6,079,852 | A | 6/2000 | Kamaya et al. |
| 6,132,072 | A | 10/2000 | Turnbull et al. |
| 6,150,771 | A | 11/2000 | Perry |
| 6,153,971 | A | 11/2000 | Shimizu et al. |
| 6,153,980 | A | 11/2000 | Marshall et al. |
| 6,161,910 | A | 12/2000 | Reisenauer et al. |
| D437,439 | S | 2/2001 | Tang |
| 6,201,353 | B1 | 3/2001 | Chang et al. |
| 6,212,213 | B1 | 4/2001 | Weber et al. |
| 6,222,172 | B1 | 4/2001 | Fossum et al. |
| 6,234,648 | B1 | 5/2001 | Borner et al. |
| 6,264,354 | B1 | 7/2001 | Motilal |
| 6,285,139 | B1 | 9/2001 | Ghanem |
| 6,329,760 | B1 | 12/2001 | Bebenroth |
| 6,329,764 | B1 | 12/2001 | van de Ven |
| 6,340,868 | B1 | 1/2002 | Lys et al. |
| 6,350,041 | B1 | 2/2002 | Tarsa et al. |
| 6,362,578 | B1 | 3/2002 | Swanson et al. |
| 6,388,393 | B1 | 5/2002 | Illingworth |
| 6,400,101 | B1 | 6/2002 | Biebl et al. |
| 6,411,155 | B2 | 6/2002 | Pezzani |
| 6,441,558 | B1 | 8/2002 | Muthu et al. |
| 6,498,440 | B2 | 12/2002 | Stam et al. |
| 6,501,630 | B1 | 12/2002 | Colclaser et al. |
| 6,513,949 | B1 | 2/2003 | Marshall et al. |
| 6,515,434 | B1 | 2/2003 | Biebl |
| 6,528,954 | B1 | 3/2003 | Lys et al. |
| 6,538,371 | B1 | 3/2003 | Duggal et al. |
| 6,550,949 | B1 | 4/2003 | Bauer et al. |
| 6,552,495 | B1 | 4/2003 | Chang |
| 6,556,067 | B2 | 4/2003 | Henry |
| 6,577,072 | B2 | 6/2003 | Saito et al. |
| 6,577,073 | B2 | 6/2003 | Shimizu et al. |
| 6,586,890 | B2 | 7/2003 | Min et al. |
| 6,600,175 | B1 | 7/2003 | Baretz et al. |
| 6,614,358 | B1 | 9/2003 | Hutchison et al. |
| 6,630,801 | B2 | 10/2003 | Schuurmans |
| 6,636,003 | B2 | 10/2003 | Rahm et al. |
| 6,692,136 | B2 | 2/2004 | Marshall et al. |
| 6,697,130 | B2 | 2/2004 | Weindorf et al. |
| 6,724,376 | B2 | 4/2004 | Sakura et al. |
| D490,181 | S | 5/2004 | Redfern |
| 6,747,420 | B2 | 6/2004 | Barth et al. |
| 6,753,661 | B2 | 6/2004 | Muthu et al. |
| 6,755,550 | B1 | 6/2004 | Lackey |
| 6,784,463 | B2 | 8/2004 | Camras et al. |
| 6,784,622 | B2 | 8/2004 | Newman, Jr. et al. |
| 6,788,011 | B2 | 9/2004 | Mueller et al. |
| 6,791,840 | B2 | 9/2004 | Chun |
| 6,808,287 | B2 | 10/2004 | Lebens et al. |
| 6,817,735 | B2 | 11/2004 | Shimizu et al. |
| 6,836,081 | B2 | 12/2004 | Swanson et al. |
| 6,841,804 | B1 | 1/2005 | Chen et al. |
| 6,841,947 | B2 | 1/2005 | Berg-johansen |
| 6,864,641 | B2 | 3/2005 | Dygert |
| 6,873,203 | B1 | 3/2005 | Latham, II et al. |
| 6,885,035 | B2 | 4/2005 | Bhat et al. |
| 6,914,267 | B2 | 7/2005 | Fukasawa et al. |
| 6,936,857 | B2 | 8/2005 | Doxsee et al. |
| 6,987,787 | B1 | 1/2006 | Mick |
| 6,995,518 | B2 | 2/2006 | Havlik et al. |
| 6,998,594 | B2 | 2/2006 | Gaines et al. |
| 7,005,679 | B2 | 2/2006 | Tarsa et al. |
| 7,008,078 | B2 | 3/2006 | Shimizu et al. |
| 7,014,336 | B1 | 3/2006 | Ducharme et al. |
| 7,014,341 | B2 | 3/2006 | King et al. |
| 7,038,399 | B2 | 5/2006 | Lys et al. |
| 7,061,454 | B2 | 6/2006 | Sasuga et al. |
| 7,066,623 | B2 | 6/2006 | Lee et al. |
| 7,067,995 | B2 | 6/2006 | Gunter et al. |
| 7,071,762 | B2 | 7/2006 | Xu et al. |
| 7,081,722 | B1 | 7/2006 | Huynh et al. |
| 7,088,059 | B2 | 8/2006 | McKinney et al. |
| 7,091,874 | B2 | 8/2006 | Smithson |
| 7,095,056 | B2 | 8/2006 | Vitta |
| 7,108,238 | B2 | 9/2006 | Gauci |
| 7,109,664 | B2 | 9/2006 | Wu |
| 7,119,498 | B2 | 10/2006 | Baldwin et al. |
| 7,144,121 | B2 | 12/2006 | Minano et al. |
| 7,180,487 | B2 | 2/2007 | Kamikawa et al. |
| 7,202,608 | B2 | 4/2007 | Robinson et al. |
| 7,213,940 | B1 | 5/2007 | Van De Ven et al. |
| 7,218,056 | B1 | 5/2007 | Harwood |
| D544,979 | S | 6/2007 | Hartmann et al. |
| 7,233,831 | B2 | 6/2007 | Blackwell |
| 7,245,089 | B2 | 7/2007 | Yang |
| D557,853 | S | 12/2007 | Sandell |
| D558,374 | S | 12/2007 | Sandell |
| 7,307,391 | B2 | 12/2007 | Shan |
| 7,344,275 | B2 | 3/2008 | Allen et al. |
| 7,352,138 | B2 | 4/2008 | Lys et al. |
| 7,358,679 | B2 | 4/2008 | Lys et al. |
| 7,358,954 | B2 | 4/2008 | Negley |
| 7,365,485 | B2 | 4/2008 | Fukasawa et al. |
| 7,408,308 | B2 | 8/2008 | Sawada et al. |
| D576,964 | S | 9/2008 | Shaner |
| 7,427,838 | B2 | 9/2008 | Hosoya |
| 7,432,668 | B2 | 10/2008 | Zwanenburg et al. |
| 7,439,945 | B1 | 10/2008 | Awalt et al. |
| 7,458,706 | B1 | 12/2008 | Liu et al. |
| 7,513,639 | B2 | 4/2009 | Wang |
| 7,515,128 | B2 | 4/2009 | Dowling |
| 7,535,180 | B2 | 5/2009 | Negley et al. |
| 7,566,154 | B2 | 7/2009 | Gloisten et al. |
| 7,576,496 | B2 | 8/2009 | Duggal et al. |
| 7,614,759 | B2 | 11/2009 | Negley |
| 7,614,767 | B2 | 11/2009 | Zulim et al. |
| 7,614,769 | B2 | 11/2009 | Sell |
| 7,637,635 | B2 | 12/2009 | Xiao et al. |
| D610,291 | S | 2/2010 | Yoshinobu et al. |
| 7,679,292 | B2 | 3/2010 | Allen et al. |
| 7,718,991 | B2 | 5/2010 | Negley |

(56) References Cited

U.S. PATENT DOCUMENTS

| | | | | |
|---|---|---|---|---|
| 7,722,220 | B2 | 5/2010 | Van de Ven | |
| D618,376 | S | 6/2010 | Redfern et al. | |
| 7,744,243 | B2 | 6/2010 | Van de Ven et al. | |
| 7,768,192 | B2 | 8/2010 | Van de Ven et al. | |
| 7,772,757 | B2 | 8/2010 | Kane et al. | |
| 7,804,256 | B2 | 9/2010 | Melanson | |
| D625,038 | S | 10/2010 | Yoo | |
| 7,812,553 | B2 | 10/2010 | Kang et al. | |
| 7,821,023 | B2 | 10/2010 | Yuan et al. | |
| 7,821,194 | B2 | 10/2010 | Negley et al. | |
| D627,502 | S | 11/2010 | Zheng et al. | |
| D627,911 | S | 11/2010 | Mo et al. | |
| 7,862,214 | B2 | 1/2011 | Trott et al. | |
| 7,871,184 | B2 | 1/2011 | Peng | |
| D633,099 | S | 2/2011 | Van de Ven | |
| 7,914,902 | B2 | 3/2011 | Kao et al. | |
| D636,921 | S | 4/2011 | Van de Ven | |
| D636,922 | S | 4/2011 | Yoshida et al. | |
| D638,160 | S | 5/2011 | Van de Ven et al. | |
| 7,967,652 | B2 | 6/2011 | Emerson | |
| 7,994,725 | B2 | 8/2011 | Bouchard | |
| 8,008,845 | B2 | 8/2011 | Van de Ven | |
| D646,011 | S | 9/2011 | Rashida | |
| 8,235,555 | B2 | 8/2012 | Thomas et al. | |
| 8,337,030 | B2 | 12/2012 | Pickard | |
| D679,033 | S | 3/2013 | Dungan et al. | |
| 8,403,721 | B2 | 3/2013 | Derman et al. | |
| 8,525,774 | B2 | 9/2013 | Lin et al. | |
| 2001/0032985 | A1 | 10/2001 | Bhat et al. | |
| 2002/0027453 | A1 | 3/2002 | Kulhalli et al. | |
| 2002/0043943 | A1 | 4/2002 | Menzer et al. | |
| 2002/0047624 | A1 | 4/2002 | Stam et al. | |
| 2002/0063534 | A1 | 5/2002 | Min | |
| 2002/0070681 | A1 | 6/2002 | Shimizu et al. | |
| 2002/0097095 | A1 | 7/2002 | Jeon et al. | |
| 2002/0139987 | A1 | 10/2002 | Collins, III et al. | |
| 2003/0030063 | A1 | 2/2003 | Sosniak et al. | |
| 2003/0067773 | A1 | 4/2003 | Marshall et al. | |
| 2003/0076034 | A1 | 4/2003 | Marshall et al. | |
| 2003/0146411 | A1 | 8/2003 | Srivastava et al. | |
| 2004/0036418 | A1 | 2/2004 | Rooke et al. | |
| 2004/0042205 | A1 | 3/2004 | Tanabe et al. | |
| 2004/0105261 | A1 | 6/2004 | Ducharme et al. | |
| 2004/0179366 | A1 | 9/2004 | Takeda et al. | |
| 2004/0208009 | A1 | 10/2004 | Mardon et al. | |
| 2004/0217364 | A1 | 11/2004 | Tarsa et al. | |
| 2005/0007164 | A1 | 1/2005 | Callahan, Jr. | |
| 2005/0057179 | A1 | 3/2005 | Madhani et al. | |
| 2005/0082974 | A1 | 4/2005 | Fukasawa et al. | |
| 2005/0111222 | A1 | 5/2005 | Olsson et al. | |
| 2005/0127381 | A1 | 6/2005 | Vitta et al. | |
| 2005/0128752 | A1 | 6/2005 | Ewington et al. | |
| 2005/0169015 | A1 | 8/2005 | Luk et al. | |
| 2005/0174065 | A1 | 8/2005 | Janning | |
| 2005/0179629 | A1 | 8/2005 | Inoue | |
| 2005/0242742 | A1 | 11/2005 | Cheang et al. | |
| 2005/0254234 | A1 | 11/2005 | Wang | |
| 2005/0276053 | A1 | 12/2005 | Nortrup et al. | |
| 2005/0280376 | A1 | 12/2005 | Hamidian et al. | |
| 2006/0012989 | A1 | 1/2006 | Lee et al. | |
| 2006/0049782 | A1 | 3/2006 | Vornsand et al. | |
| 2006/0060882 | A1 | 3/2006 | Ohe et al. | |
| 2006/0105482 | A1 | 5/2006 | Alferink et al. | |
| 2006/0153511 | A1 | 7/2006 | Franklin et al. | |
| 2006/0176411 | A1 | 8/2006 | Furukawa | |
| 2006/0180818 | A1 | 8/2006 | Nagai et al. | |
| 2006/0186819 | A1* | 8/2006 | Young | 315/158 |
| 2006/0221609 | A1 | 10/2006 | Ryan, Jr. | |
| 2006/0238465 | A1 | 10/2006 | Kurumisawa | |
| 2006/0244396 | A1 | 11/2006 | Bucur | |
| 2007/0001188 | A1 | 1/2007 | Lee | |
| 2007/0013620 | A1 | 1/2007 | Tanahashi et al. | |
| 2007/0018594 | A1 | 1/2007 | Janning | |
| 2007/0040512 | A1 | 2/2007 | Jungwirth et al. | |
| 2007/0096661 | A1 | 5/2007 | Allen | |
| 2007/0108843 | A1 | 5/2007 | Preston et al. | |
| 2007/0115228 | A1 | 5/2007 | Roberts et al. | |
| 2007/0115662 | A1 | 5/2007 | Roberts et al. | |
| 2007/0137074 | A1 | 6/2007 | Van de Ven | |
| 2007/0139920 | A1 | 6/2007 | Van de Ven | |
| 2007/0139923 | A1 | 6/2007 | Negley | |
| 2007/0159091 | A1 | 7/2007 | Hirosaki et al. | |
| 2007/0170447 | A1 | 7/2007 | Negley | |
| 2007/0171145 | A1 | 7/2007 | Coleman | |
| 2007/0182338 | A1 | 8/2007 | Shteynberg et al. | |
| 2007/0182346 | A1 | 8/2007 | Shteynberg et al. | |
| 2007/0182347 | A1 | 8/2007 | Shteynberg et al. | |
| 2007/0215027 | A1 | 9/2007 | MacDonald et al. | |
| 2007/0235751 | A1 | 10/2007 | Radkov et al. | |
| 2007/0236911 | A1 | 10/2007 | Negley | |
| 2007/0236920 | A1 | 10/2007 | Snyder | |
| 2007/0247414 | A1* | 10/2007 | Roberts | 345/102 |
| 2007/0257623 | A1 | 11/2007 | Johnson et al. | |
| 2007/0257999 | A1 | 11/2007 | Chou | |
| 2007/0263393 | A1 | 11/2007 | Van de Ven | |
| 2007/0267978 | A1 | 11/2007 | Shteynberg et al. | |
| 2007/0267983 | A1 | 11/2007 | Van de Ven | |
| 2007/0268694 | A1 | 11/2007 | Bailey et al. | |
| 2007/0274063 | A1 | 11/2007 | Negley | |
| 2007/0274080 | A1 | 11/2007 | Negley | |
| 2007/0278503 | A1 | 12/2007 | Van de Ven | |
| 2007/0278934 | A1 | 12/2007 | Van de Ven | |
| 2007/0278974 | A1 | 12/2007 | Van de Ven | |
| 2007/0279440 | A1 | 12/2007 | Negley | |
| 2007/0279903 | A1 | 12/2007 | Negley | |
| 2007/0280624 | A1 | 12/2007 | Negley | |
| 2007/0285031 | A1 | 12/2007 | Shteynberg et al. | |
| 2008/0018261 | A1 | 1/2008 | Kastner | |
| 2008/0030993 | A1 | 2/2008 | Narendran et al. | |
| 2008/0054281 | A1 | 3/2008 | Narendran et al. | |
| 2008/0062070 | A1 | 3/2008 | De Oto et al. | |
| 2008/0084685 | A1 | 4/2008 | Van de Ven | |
| 2008/0084700 | A1 | 4/2008 | Van de Ven | |
| 2008/0084701 | A1 | 4/2008 | Van de Ven | |
| 2008/0088248 | A1 | 4/2008 | Myers | |
| 2008/0089053 | A1 | 4/2008 | Negley | |
| 2008/0089071 | A1 | 4/2008 | Wang | |
| 2008/0094000 | A1 | 4/2008 | Yamamoto et al. | |
| 2008/0094829 | A1 | 4/2008 | Narendran et al. | |
| 2008/0105887 | A1 | 5/2008 | Narendran et al. | |
| 2008/0106895 | A1 | 5/2008 | Van de Ven | |
| 2008/0106907 | A1 | 5/2008 | Trott | |
| 2008/0112168 | A1 | 5/2008 | Pickard | |
| 2008/0112170 | A1 | 5/2008 | Trott | |
| 2008/0112183 | A1 | 5/2008 | Negley | |
| 2008/0116818 | A1 | 5/2008 | Shteynberg et al. | |
| 2008/0117500 | A1 | 5/2008 | Narendran et al. | |
| 2008/0122376 | A1 | 5/2008 | Lys | |
| 2008/0128718 | A1 | 6/2008 | Sumitani | |
| 2008/0129220 | A1 | 6/2008 | Shteynberg et al. | |
| 2008/0130283 | A1 | 6/2008 | Chang | |
| 2008/0130285 | A1 | 6/2008 | Negley | |
| 2008/0130298 | A1 | 6/2008 | Negley | |
| 2008/0136313 | A1 | 6/2008 | Van de Ven | |
| 2008/0137347 | A1 | 6/2008 | Trott | |
| 2008/0157688 | A1 | 7/2008 | Gibboney | |
| 2008/0179602 | A1 | 7/2008 | Negley et al. | |
| 2008/0186704 | A1 | 8/2008 | Chou et al. | |
| 2008/0211415 | A1 | 9/2008 | Altamura | |
| 2008/0215279 | A1 | 9/2008 | Salsbury et al. | |
| 2008/0252197 | A1 | 10/2008 | Li et al. | |
| 2008/0258628 | A1 | 10/2008 | Higley et al. | |
| 2008/0259589 | A1 | 10/2008 | Van de Ven | |
| 2008/0278928 | A1 | 11/2008 | Van de Ven | |
| 2008/0278940 | A1 | 11/2008 | Van de Ven | |
| 2008/0278950 | A1 | 11/2008 | Pickard | |
| 2008/0278952 | A1 | 11/2008 | Trott | |
| 2008/0278957 | A1 | 11/2008 | Pickard | |
| 2008/0304260 | A1 | 12/2008 | Van de Ven | |
| 2008/0304261 | A1 | 12/2008 | Van de Ven | |
| 2008/0304269 | A1 | 12/2008 | Pickard | |
| 2008/0309255 | A1 | 12/2008 | Myers et al. | |
| 2009/0034283 | A1 | 2/2009 | Albright et al. | |
| 2009/0039791 | A1 | 2/2009 | Jones | |

(56) References Cited

U.S. PATENT DOCUMENTS

| | | | | |
|---|---|---|---|---|
| 2009/0046464 | A1 | 2/2009 | Liu et al. | |
| 2009/0059582 | A1 | 3/2009 | Kulkarni | |
| 2009/0079355 | A1 | 3/2009 | Zhou et al. | |
| 2009/0079357 | A1 | 3/2009 | Shteynberg et al. | |
| 2009/0079358 | A1 | 3/2009 | Shteynberg et al. | |
| 2009/0079359 | A1 | 3/2009 | Shteynberg et al. | |
| 2009/0079360 | A1 | 3/2009 | Shteynberg et al. | |
| 2009/0079362 | A1 | 3/2009 | Shteynberg et al. | |
| 2009/0086474 | A1 | 4/2009 | Chou | |
| 2009/0101930 | A1 | 4/2009 | Li | |
| 2009/0108269 | A1 | 4/2009 | Negley | |
| 2009/0121238 | A1 | 5/2009 | Peck | |
| 2009/0140630 | A1 | 6/2009 | Kijima et al. | |
| 2009/0147517 | A1 | 6/2009 | Li et al. | |
| 2009/0160363 | A1 | 6/2009 | Negley et al. | |
| 2009/0161356 | A1 | 6/2009 | Negley | |
| 2009/0184616 | A1 | 7/2009 | Van De Ven et al. | |
| 2009/0184662 | A1 | 7/2009 | Given et al. | |
| 2009/0184666 | A1 | 7/2009 | Myers | |
| 2009/0189529 | A1 | 7/2009 | Negley et al. | |
| 2009/0195168 | A1 | 8/2009 | Greenfeld | |
| 2009/0251918 | A1* | 10/2009 | Engl et al. | 362/555 |
| 2009/0251934 | A1 | 10/2009 | Shteynberg et al. | |
| 2009/0296384 | A1 | 12/2009 | Van de Ven et al. | |
| 2009/0316393 | A1 | 12/2009 | Vissenberg et al. | |
| 2010/0001648 | A1* | 1/2010 | De Clercq et al. | 315/113 |
| 2010/0002440 | A1 | 1/2010 | Negley et al. | |
| 2010/0026187 | A1 | 2/2010 | Kelly et al. | |
| 2010/0026208 | A1 | 2/2010 | Shteynberg et al. | |
| 2010/0045187 | A1 | 2/2010 | Shteynberg et al. | |
| 2010/0045210 | A1 | 2/2010 | Hariharan | |
| 2010/0060130 | A1 | 3/2010 | Li | |
| 2010/0060175 | A1* | 3/2010 | Lethellier | 315/164 |
| 2010/0060181 | A1 | 3/2010 | Choi et al. | |
| 2010/0067227 | A1 | 3/2010 | Budike | |
| 2010/0072902 | A1 | 3/2010 | Wendt et al. | |
| 2010/0079059 | A1 | 4/2010 | Roberts et al. | |
| 2010/0079076 | A1 | 4/2010 | Chang et al. | |
| 2010/0079262 | A1 | 4/2010 | Van Laanen | |
| 2010/0090604 | A1 | 4/2010 | Maruyama et al. | |
| 2010/0102119 | A1 | 4/2010 | Gustin et al. | |
| 2010/0102199 | A1 | 4/2010 | Negley | |
| 2010/0102697 | A1 | 4/2010 | Van de Ven | |
| 2010/0103660 | A1 | 4/2010 | Van de Ven | |
| 2010/0103678 | A1 | 4/2010 | Van de Ven | |
| 2010/0109537 | A1 | 5/2010 | Nishino et al. | |
| 2010/0109560 | A1 | 5/2010 | Yu et al. | |
| 2010/0109570 | A1 | 5/2010 | Weaver | |
| 2010/0127282 | A1 | 5/2010 | Harbers et al. | |
| 2010/0127283 | A1 | 5/2010 | Van de Ven et al. | |
| 2010/0134018 | A1 | 6/2010 | Tziony et al. | |
| 2010/0135016 | A1 | 6/2010 | Ishibashi | |
| 2010/0141159 | A1 | 6/2010 | Shiu et al. | |
| 2010/0177509 | A1 | 7/2010 | Pickard | |
| 2010/0194274 | A1 | 8/2010 | Hoogzaad | |
| 2010/0213859 | A1 | 8/2010 | Shteynberg et al. | |
| 2010/0225220 | A1 | 9/2010 | Tanaka et al. | |
| 2010/0231135 | A1 | 9/2010 | Hum et al. | |
| 2010/0238645 | A1 | 9/2010 | Bailey | |
| 2010/0246177 | A1 | 9/2010 | Van de Ven | |
| 2010/0259182 | A1 | 10/2010 | Man et al. | |
| 2010/0290222 | A1 | 11/2010 | Pickard et al. | |
| 2010/0308738 | A1 | 12/2010 | Shteynberg et al. | |
| 2010/0308739 | A1 | 12/2010 | Shteynberg et al. | |
| 2011/0025217 | A1 | 2/2011 | Zhan et al. | |
| 2011/0031894 | A1 | 2/2011 | Van de Ven | |
| 2011/0037409 | A1 | 2/2011 | Van de Ven | |
| 2011/0037413 | A1 | 2/2011 | Negley et al. | |
| 2011/0050070 | A1 | 3/2011 | Pickard | |
| 2011/0068696 | A1 | 3/2011 | van de Ven et al. | |
| 2011/0068701 | A1 | 3/2011 | Van De Ven et al. | |
| 2011/0068702 | A1* | 3/2011 | van de Ven et al. | 315/186 |
| 2011/0074265 | A1 | 3/2011 | Van de Ven | |
| 2011/0074270 | A1 | 3/2011 | Van de Ven et al. | |
| 2011/0074289 | A1 | 3/2011 | Van de Ven | |
| 2011/0075411 | A1 | 3/2011 | Van de Ven et al. | |
| 2011/0075414 | A1 | 3/2011 | Van de Ven et al. | |
| 2011/0075422 | A1 | 3/2011 | Van de Ven et al. | |
| 2011/0075423 | A1 | 3/2011 | Van de Ven | |
| 2011/0084614 | A1* | 4/2011 | Eisele et al. | 315/152 |
| 2011/0089830 | A1 | 4/2011 | Pickard et al. | |
| 2011/0089838 | A1 | 4/2011 | Pickard et al. | |
| 2011/0090686 | A1 | 4/2011 | Pickard et al. | |
| 2011/0109228 | A1 | 5/2011 | Shimomura et al. | |
| 2011/0115394 | A1 | 5/2011 | Shteynberg et al. | |
| 2011/0115411 | A1 | 5/2011 | Shteynberg et al. | |
| 2011/0121754 | A1 | 5/2011 | Shteynberg et al. | |
| 2011/0148314 | A1 | 6/2011 | Lin et al. | |
| 2011/0198984 | A1 | 8/2011 | Van de Ven | |
| 2011/0211351 | A1 | 9/2011 | Van de Ven | |
| 2011/0227484 | A1 | 9/2011 | Huynh | |
| 2011/0227485 | A1 | 9/2011 | Huynh | |
| 2011/0227489 | A1 | 9/2011 | Huynh | |
| 2011/0227490 | A1 | 9/2011 | Huynh | |
| 2011/0273102 | A1 | 11/2011 | van de Ven et al. | |
| 2011/0309760 | A1 | 12/2011 | Beland et al. | |
| 2012/0176826 | A1 | 7/2012 | Lazar | |
| 2012/0313545 | A1 | 12/2012 | Courtel | |
| 2013/0278157 | A1 | 10/2013 | Radermacher | |

FOREIGN PATENT DOCUMENTS

| | | | |
|---|---|---|---|
| EP | 2 083 211 | | 7/2009 |
| JP | 59-113768 | A | 6/1984 |
| JP | 4 196359 | A | 7/1992 |
| JP | 10-163535 | | 6/1998 |
| JP | 2003-515956 | | 5/2003 |
| JP | 2003-273404 | A | 9/2003 |
| JP | 2003-529889 | | 10/2003 |
| JP | 2004-080046 | | 3/2004 |
| JP | 2004-103443 | | 4/2004 |
| JP | 2004-356116 | | 12/2004 |
| JP | 2005-142311 | | 6/2005 |
| JP | 2005-310997 | A | 11/2005 |
| JP | 2006-103404 | A | 4/2006 |
| JP | 2006-332022 | A | 12/2006 |
| JP | 2009-049010 | A | 3/2009 |
| JP | 2010-092776 | A | 4/2010 |
| WO | WO 03/096761 | A1 | 11/2003 |
| WO | WO 2005/013365 | | 2/2005 |
| WO | WO 2005/124877 | | 12/2005 |
| WO | WO 2006/007388 | A1 | 1/2006 |
| WO | WO 2006/018604 | A1 | 2/2006 |
| WO | WO 2006/028312 | | 3/2006 |
| WO | WO 2008/010130 | | 1/2008 |
| WO | WO 2008/036873 | | 3/2008 |
| WO | WO 2008/051957 | | 5/2008 |
| WO | WO 2008/061082 | | 5/2008 |
| WO | WO 2008/129504 | | 10/2008 |
| WO | WO 2008/137974 | | 11/2008 |
| WO | WO 2009/046050 | | 4/2009 |
| WO | WO 2010/038025 | | 4/2010 |

OTHER PUBLICATIONS

U.S. Appl. No. 12/328,115, filed Dec. 4, 2008, Chobot.

U.S. Appl. No. 11/854,744, filed Sep. 13, 2007, Myers.

U.S. Appl. No. 60/844,325, filed Sep. 13, 2006, Meyers.

"*ASSIST Recommends . . . LED Life For General Lighting: Definition of Life*", vol. 1, Issue 1, Feb. 2005.

"*Bright Tomorrow Lighting Competition* (*L Prize*™)", May 28, 2008, Document No. 08NT006643.

"*ENERGY STAR® Program Requirements for Solid State Lighting Luminaires, Eligibility Criteria—Version 1.1*", Final: Dec. 19, 2008.

Application Note: CLD-APO6.006, entitled *Cree® XLamp® XR Family & 4550 LED Reliability*, published at cree.com/xlamp, Sep. 2008.

Bulborama, Lighting Terms Reference and Glossary, http://www.bulborama.com/store/lightingreferenceglossary-13.html, 6 pages.

Cree XLamp 7090 XR-E Series LED Binning and Labeling, Copyright 2006, Retrieved from the internet at URL http://www.pro-light.ip/data/xr_e_bin.pdf.

(56) References Cited

OTHER PUBLICATIONS

DuPont "*DuPont™ Diffuse Light Reflector*", Publication K-20044, May 2008, 2 pages.
EXM020, Multi-Channel 160W LED Driver, Rev. 2.0 Nov. 2010, 13 pages, www.exclara.com.
EXM055, 14.8W Dimmable LED Ballast, Rev. 0.7, Mar. 11, 2011, 10 pages, www.exclara.com.
EXM057, 14.5W Dimmable LED Ballast, Rev. 0.5, Mar. 11, 2011, 8 pages, www.exclara.com.
Furukawa Electric Co., Ltd., Data Sheet, "*New Material for Illuminated Panels Microcellular Reflective Sheet MCPET*", updated Apr. 8, 2008, 2 pages.
Global Patent Literature Text Search Corresponding to PCT Application No. PCT/US2011/38995; Date of Search: Sep. 8, 2011; 7 pages.
Illuminating Engineering Society Standard LM-80-08, entitled "*IES Approved Method for Measuring Lumen Maintenance of LED Light Sources*", Sep. 22, 2008, ISBN No. 978-0-87995-227-3.
Kim et al. "Strongly Enhanced Phosphor Efficiency in GaInN White Light-Emitting Diodes Using Remote Phosphor Configuration and Diffuse Reflector Cup" *Japanese Journal of Applied Physics* 44(21):L649-L651 (2005).
LEDs Magazine, Press Release May 23, 2007, "*Furukawa America Debuts MCPET Reflective Sheets to Improve Clarity, Efficiency of Lighting Fixtures*", downloaded Jun. 25, 2009 from http://www.ledsmagazine.com/press/15145, 2 pages.
Lighting Research Center, Rensselaer Polytechnic Institute, "What is color consistency?" NLPIP, vol. 8, Issue 1, Oct. 2004. Retrieved from the internet: http://www.Lrc.rpi.edu/programs/nlpip/lichtinganswers/lichtsources/whatisColorConsistency.asp.
MCPET—Microcellular Reflective Sheet Properties, http://www.trocellen.com, downloaded Jun. 25, 2009, 2 pages.
Philips Lumileds, Technology White Paper: "Understanding power LED lifetime analysis", downloaded from http://www.philipslumileds.com/pdfs/WP12.pdf, Document No. WP12, Last Modified May 22, 2007.
Sutardja, P., "Design for High Quality and Low Cost SSL with Power Factor Correction", Marvell Semiconductor Inc. Jul. 2011. 16 pages.
U.S. Appl. No. 61/245,683, filed Sep. 25, 2009, Van de Ven.
U.S. Appl. No. 61/245,688, filed Sep. 25, 2009, Pickard.
Van de Ven et al. "Warm White Illumination with High CRI and High Efficacy by Combining 455 nm Excited Yellowish Phosphor LEDs and Red AlInGaP LEDs", First International Conference on White LEDs and Solid State Lighting, Nov. 26-30, 2007.

* cited by examiner

TEMPERATURE RESPONSIVE CONTROL FOR LIGHTING APPARATUS INCLUDING LIGHT EMITTING DEVICES PROVIDING DIFFERENT CHROMATICITIES AND RELATED METHODS

RELATED APPLICATIONS

The present application claims the benefit of priority as a continuation-in-part of U.S, application Ser. No. 12/704,730 filed Feb. 12, 2010, which claims the benefit of priority as a continuation-in-part of U.S. application Ser. No. 12/566,195 filed Sep. 24, 2009, and which also claims the benefit of priority from U.S. Application No. 61/293,300 filed Jan. 8, 2010, and from U.S. Application No. 61/294,958 filed Jan. 14, 2010.

FIELD

The present inventive subject matter relates to lighting apparatus and, more particularly, to solid state lighting apparatus.

BACKGROUND

Solid state lighting apparatus are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region. A solid state light emitting device typically emits light having a specific wavelength that is a characteristic of the material(s) (e.g., semiconductor material or materials) used in the light emitting layer or region. Stated in other words, solid state light emitting devices are typically monochromatic.

The color rendering index (CRI) of a light source is an objective measure of the ability of the light generated by the source to accurately illuminate a broad range of colors. The color rendering index ranges from essentially zero for monochromatic sources (e.g., semiconductor light emitting diodes) to nearly 100 for incandescent sources. To improve color output, a solid state light emitting device that generates light having a first wavelength (e.g., blue light) may be combined with a phosphor that converts a portion of the light emitted by the solid state lighting device (having the first wavelength) to a second wavelength (e.g., yellow light), and light having the first and second wavelengths may be combined. For example, a yellow phosphor may be provided with/on a light emitting diode emitting blue light to provide a blue-shifted-yellow (BSY) light source. Light generated from such phosphor-based solid state light sources, however, may still have relatively low color rendering indices.

It may be desirable to provide a lighting source that generates a white light having a high color rendering index, so that objects and/or display screens illuminated by the lighting panel may appear more natural. Accordingly, to improve CRI, red light may be added to BSY light generated by a blue LED and a yellow phosphor, for example, by adding red emitting phosphor and/or red emitting devices to the apparatus. Other lighting sources may include red, green and blue light emitting devices. When such combinations of light emitting devices are energized simultaneously, the resulting combined light may appear white, or nearly white, depending on the relative intensities of the red, green and blue sources.

In a lighting apparatus providing directed illumination, a plurality of light emitting devices having different chromaticities may be arranged so that light emitted thereby is combined to provide a combined optical output. Moreover, the light emitting devices may be configured in/on the lighting apparatus to provide that the optical output has one or more of a desired color, dominant wavelength, CRI, correlated color temperature (CCT), etc., and/or to provide that the optical output is not significantly diffused. In such apparatus, there continues to exist a need for control of uniformity of the optical output over expected ranges of operating temperatures.

SUMMARY

According to some embodiments, a lighting apparatus may include a plurality of light emitting devices, a temperature sensor, and a compensation circuit. The plurality of light emitting devices may include a first light emitting device configured to emit light having a first chromaticity, a second light emitting device configured to emit light having a second chromaticity different than the first chromaticity, and a third light emitting device configured to emit light having the second chromaticity. Moreover, the first, second, and third light emitting devices may be electrically coupled in series. The temperature sensor may be configured to generate a temperature sense signal responsive to heat generated by at least one of the plurality of light emitting devices. The compensation circuit may be coupled to the third light emitting device with the compensation circuit being configured to vary a level of electrical current through the third light emitting device relative to the electrical current through the first and second light emitting devices responsive to the temperature sense signal.

According to some other embodiments, a lighting apparatus may include a plurality of light emitting devices, a temperature sensor, and a compensation circuit. The plurality of light emitting devices may include a first light emitting device configured to emit light having a first chromaticity and a second light emitting device configured to emit light having a second chromaticity different than the first chromaticity, and the plurality of light emitting devices may be oriented to combine the light emitted thereby to provide a combined optical output. The temperature sensor may be configured to generate a temperature sense signal responsive to heat generated by at least one of the plurality of light emitting devices. The compensation circuit may be coupled to the second light emitting device, with the compensation circuit being configured to vary an electrical current passing through the second light emitting device responsive to the temperature sense signal. More particularly, the compensation circuit may be configured to set a first level of current passing through the second light emitting device so that the combined optical output has a first color responsive to a first temperature sense signal representing a first temperature, and the compensation circuit may be configured to set a second level of current passing through the second light emitting device different than the first level so that the combined optical output has a second color different than the first color responsive to a second temperature sense signal representing a second temperature greater than the first temperature. More particularly, the first color may be redder than the second color.

According to still other embodiments, a lighting apparatus may include a plurality of light emitting devices including a first light emitting device configured to emit light having a first chromaticity, a second light emitting device configured to emit light having a second chromaticity different than the first chromaticity, and a third light emitting device configured to emit light having the second chromaticity. Moreover, the first, second, and third light emitting devices may be electrically coupled in series. This apparatus may be operated by varying a level of electrical current through the third light emitting device relative to the electrical current through the first and second light emitting devices responsive to a temperature of the lighting apparatus.

According to yet other embodiments, a lighting apparatus may include a plurality of light emitting devices including a first light emitting device configured to emit light having a first chromaticity and a second light emitting device configured to emit light having a second chromaticity different than the first chromaticity, with the plurality of light emitting devices being oriented to combine the light emitted thereby to provide a combined optical output. This apparatus may be operated by setting a first level of current passing through the second light emitting device so that the combined optical output has a first color responsive to a first temperature of the lighting apparatus. A second level of current passing through the second light emitting device may be set different than the first level so that the combined optical output has a second color different than the first color responsive to a second temperature of the lighting apparatus greater than the first temperature. More particularly, the first color may be redder than the second color. Stated in other words, the first color may have a higher component of red relative to other wavelengths of light making up the combined optical output than the second color.

BRIEF DESCRIPTION OF THE DRAWINGS

The accompanying drawings, which are included to provide a further understanding of the present subject matter and are incorporated in and constitute a part of this application, illustrate certain embodiment(s) of the present subject matter.

DETAILED DESCRIPTION

Figure 1:
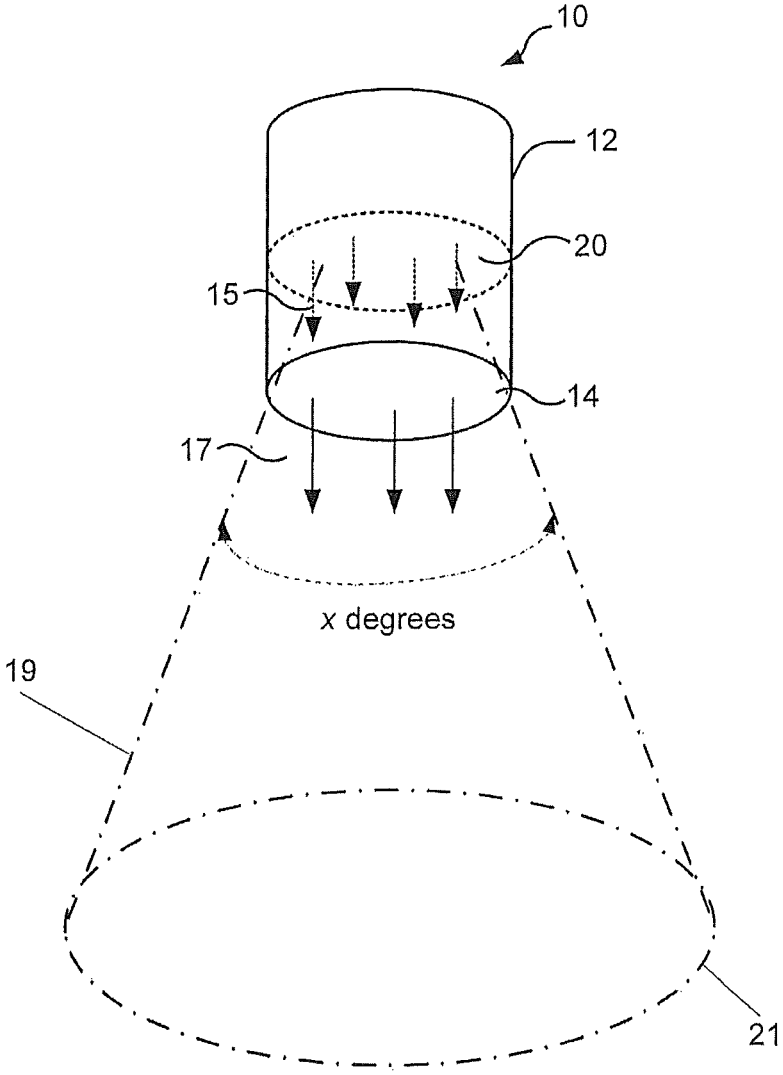
FIG. 1 is a perspective view of a solid state lighting device according to some embodiments of the present inventive subject matter.

Embodiments of the present inventive subject matter now will be described more fully hereinafter with reference to the accompanying drawings, in which embodiments of the present inventive subject matter are shown. This present inventive subject matter may, however, be embodied in many different forms and should not be construed as limited to the embodiments set forth herein. Rather, these embodiments are provided so that this disclosure will be thorough and complete, and will fully convey the scope of the present inventive subject matter to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

Referring to FIGS. 1-4, a lighting device 10 according to some embodiments is illustrated. The lighting apparatus 10 shown in FIGS. 1-4 is a "can" lighting fixture that may be suitable for use in general illumination applications as a down light or spot light. However, it will be appreciated that a lighting apparatus according to some embodiments may have a different form factor. For example, a lighting apparatus according to some embodiments can have the shape of a conventional light bulb, a pan or tray light, an automotive headlamp, or any other suitable form.

Figure 2:
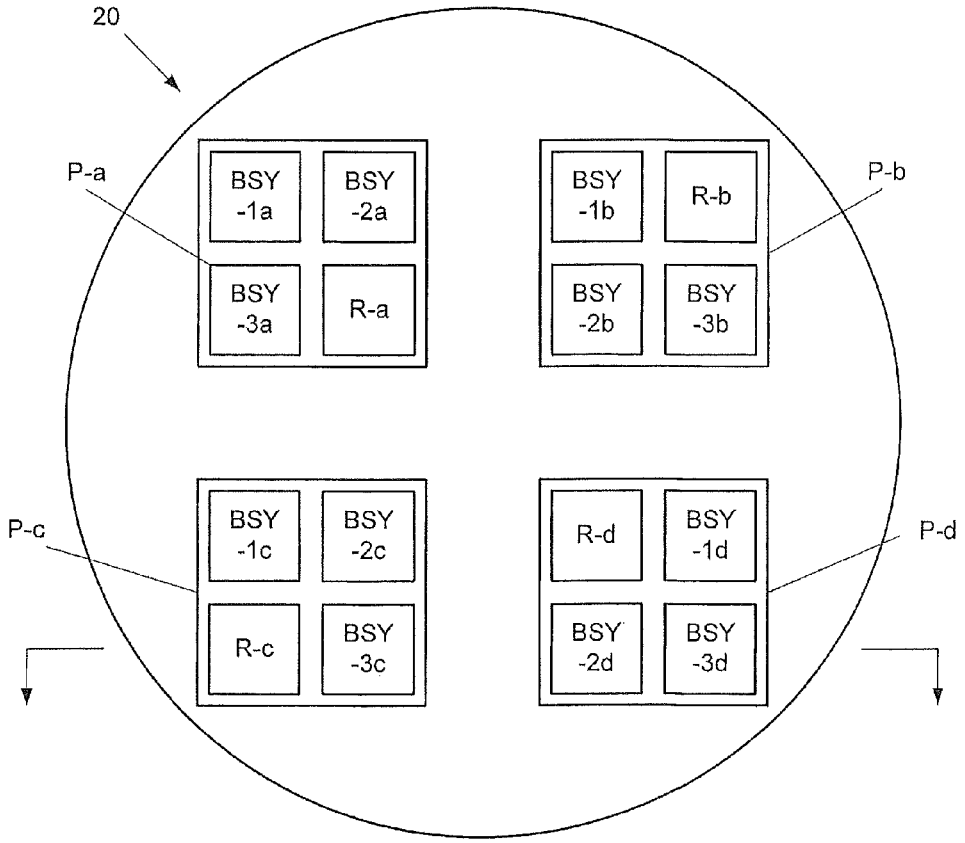
FIG. 2 illustrates a plan view of a lighting panel including a plurality of light emitting devices according to some embodiments of the present inventive subject matter.
Figure 3:
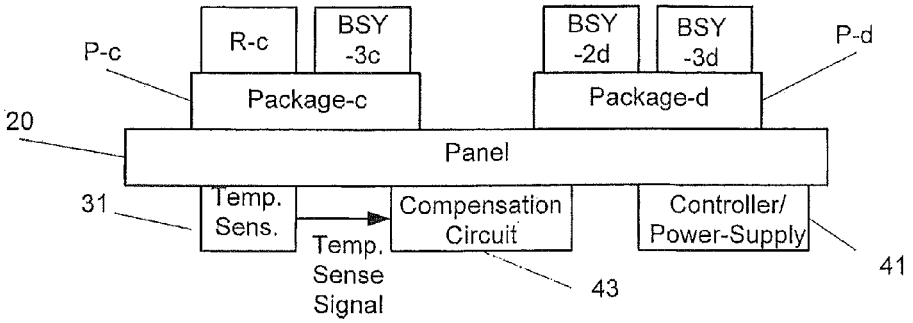
FIG. 3 is a cross sectional view of the lighting panel of FIG. 2 according to some embodiments of the present inventive subject matter.

The lighting apparatus 10 generally includes a can shaped outer housing 12 in which a lighting panel 20 is arranged. In the embodiments illustrated in FIGS. 1-4, the lighting panel 20 has a generally circular shape so as to fit within an interior of the cylindrical housing 12. Light may be generated by solid state blue-shifted-yellow light emitting devices (LEDs) BSY-1*a*, BSY-2*a*, BSY-3*a*, BSY-1*b*, BSY-2*b*, BSY-3*b*, BSY-1*c*, BSY-2*c*, BSY-3*c*, BSY-1*d*, BSY-2*d*, and BSY-3*d*, and by solid state red light emitting devices R-a, R-b, R-c, and R-d which are mounted on lighting panel 20. The light emitting devices may be separately provided on lighting panel 20, or groups of the light emitting devices may be mounted on respective packaging substrates P-a, P-b, P-c, and P-d which are in turn mounted on lighting panel 20 as shown in FIGS. 2 and 3.

The light emitting devices (BSY and R) may be arranged on the lighting panel 20 to emit light 15 toward a directed beam optic system (e.g., a lens) 14 mounted at the end of the housing 12. The light emitting devices BSY and R, for example, may be configured to emit light through the directed beam optic system 14 to provide a Full-Width-at-Half-Maximum (FWHM) cone angle of no more than about 60 degrees (no more than a 60 degree lamp), or more particularly, no more than about 30 degrees (no more than a 30 degree lamp), no more than about 20 degrees (no more than a 20 degree lamp), or even no more than about 16 degrees (no more than a 16 degree lamp). With a FWHM cone angle, peak Center Beam CandlePower (CBCP) is a measure of the light intensity at the center of distribution of optical output 21, and the FWHM cone angle (x in FIG. 1) defines an area of optical output 21 that captures peak CBCP intensity (at the center of optical output 21) to 50% of peak CBCP intensity (adjacent the perimeter of optical output 21). Accordingly, the lighting device 10 may be substantially free of diffusing optical elements, and more particularly, directed beam optic system 14 may be substantially non-diffusing. Directed beam optic system 14 may thus include a lens (or lenses) that redirect and/or focus light emitted by the light emitting devices BSY and R in a desired near-field and/or far-field pattern. Directed beam optic system 14, for example, may include collimating optical system such as a Totally Internally Reflecting (TIR) lens, an array of lenses across a surface thereof, one or more Fresnel lenses, etc.

While multi-chip packages and directed beam optics are discussed by way of example, other embodiments may be implemented without multi-chip packages and/or without directed beam optics. For example, embodiments may be implemented with diffuse and/or non-directed beam optics, and/or with single chip packages. In diffuse and/or non-directed beam applications, for example, embodiments may provide advantages of compensating for differences in red and blue output at lower currents during dimming. Moreover single chip light emitting devices (where one or more of light emitting devices BSY/R are separately mounted on lighting panel 20 without a packaging substrate P or with a single chip packaging substrate) may be provided with separate TIR lenses according to other embodiments.

Solid-state lighting apparatus 10 may thus include a plurality of blue-shifted-yellow light emitting devices BSY providing light having a first chromaticity and a plurality of red light emitting devices R providing light having a second chromaticity different than the first chromaticity. In some embodiments, each of blue-shifted-yellow light emitting devices BSY may be provided, for example, using an InGaN (indium gallium nitride) light emitting diode and a yellow phosphor such as $Y_3Al_5O_{12}$:Ce (YAG), so that the InGaN light emitting diode emits blue light, some of which is converted to yellow light by the YAG phosphor. Each of red light emitting devices R may be provided, for example, using an GaAs (gallium arsenide) light emitting diode. The combined light emitted by the plurality of blue-shifted-yellow and red light emitting devices BSY and R of FIGS. 1-4 may be a warm white light that has a relatively high Color Rendering Index (CRI). While blue-shifted-yellow and red light emitting devices are discussed herein by way of example, embodiments of the present inventive subject matter may be implemented using different diodes, phosphors, wavelengths, materials, etc., as long as light emitting devices providing light having different chromaticities are used. Solid state blue-shifted-yellow and red light emitting devices and assemblies including the same are discussed, for example, in U.S. patent application Ser. No. 12/776,947 filed May 10, 2010, and entitled "Lighting Device With Multi-Chip Light Emitters, Solid State Light Emitter Support Members And Lighting Elements;" in U.S. Publication No. 2011/0068702 entitled "Solid State Lighting Apparatus With Controllable Bypass Circuits And Methods Of Operation Thereof;" and in U.S. Publication No. 2011/0068701 also entitled "Solid State Lighting Apparatus With Controllable Bypass Circuits And Methods Of Operation Thereof." The disclosures of each of the above referenced patents and patent publications are hereby incorporated herein in their entireties by reference.

The chromaticity of a particular light source may be referred to as the "color point" of the source. For a white light source, the chromaticity may be referred to as the "white point" of the source. The white point of a white light source may fall along a locus of chromaticity points corresponding to the color of light emitted by a black-body radiator heated to a given temperature. Accordingly, a white point may be identified by a correlated color temperature (CCT) of the light source, which is the temperature at which the heated black-body radiator matches the hue of the light source. White light typically has a CCT of between about 2500K and 8000K. White light with a CCT of 2500K has a reddish color, white light with a CCT of 4000K has a yellowish color, and while light with a CCT of 8000K has a bluish color. By appropriately balancing numbers/sizes/etc. of blue-shifted-yellow light emitting devices and red light emitting devices, by spatially distributing blue-shifted-yellow and red light emitting devices, and by providing control of currents through the light emitting devices, a desired color of the combined optical output may be provided.

In the lighting device 10 of FIGS. 1-4, blue-shifted-yellow and red light emitting devices BSY and R may be spatially distributed across panel 20 to provide that blue-shifted-yellow and red components are sufficiently mixed in the resulting optical output 21. As shown in FIGS. 2 and 3, for example, groups of 4 light emitting devices may be provided on respective packaging substrates P-a, P-b, P-c, and P-d, and packaging substrates may be provided on lighting panel 20. More particularly, each packaging substrate P may include three blue-shifted-yellow light emitting devices BSY and one red light emitting device R so that the red light emitting devices R are spatially distributed among the blue-shifted-yellow light emitting devices BSY across panel 20. In addition, locations of the red light emitting devices R may be varied on each of the packages P so that the red light emitting devices appear in different quadrants of the respective packages P. Spatial distribution of light emitting devices is discussed, for example, in U.S. patent application Ser. No. 12/776,947 filed May 10, 2010, and entitled "Lighting Device With Multi-Chip Light Emitters, Solid State Light Emitter Support Members And Lighting Elements," the disclosure of which is hereby incorporated herein in its entirety by reference.

Light emitting devices BSY and R may be electrically and mechanically coupled to packaging substrates P (e.g., using one or more of solder bonds, wirebonds, adhesives, etc.), and packaging substrates P may be electrically and mechanically coupled to lighting panel 20. More particularly, electrical terminals (e.g., anodes and cathodes) of each light emitting device BSY and R may be separately coupled through respective packaging substrates P to panel 20, and panel 20 may provide electrical couplings between light emitting devices BSY and R and control elements (such as controller/power-supply 41 and compensation circuit 43) as shown in FIG. 4.

In addition, temperature sensor 31 may be configured to generate a temperature sense signal responsive to heat generated by one or more of light emitting devices BSY and/or R. Temperature sensor 31, for example, may be thermally coupled to one or more of light emitting devices BSY and/or R through panel 20 and a packaging substrate P as shown in FIG. 3, temperature sensor 31 may be thermally coupled to one or more of light emitting devices BSY and/or R through a respective packaging substrate P (e.g., temperature sensor may be provided directly on a packaging substrate P), and/or temperature sensor 31 may be thermally coupled directly to one of light emitting devices BSY and/or R. Temperature sensor 31 may thus be configured to generate the temperature sense signal responsive to a junction temperature of one or more of light emitting devices BSY and/or R. While a temperature actually sensed by temperature sensor 31 may be less than an actual junction temperature of one or more light emitting devices, a proportional relationship may exist between the sensed temperature and one or more light emitting device junction temperatures. While temperature sensor 31 and compensation circuit 43 are shown separately, elements thereof may be combined and/or shared. Temperature sensor 31, for example, may include a thermistor, and compensation circuit 43 may include a driver circuit configured to generate an electrical signal that is applied to the thermistor so that an output of the thermistor varies responsive to a temperature of the thermistor. According to other embodiments, compensation circuit 43 may be defined to include all elements of temperature sensor 31.

Figure 4:
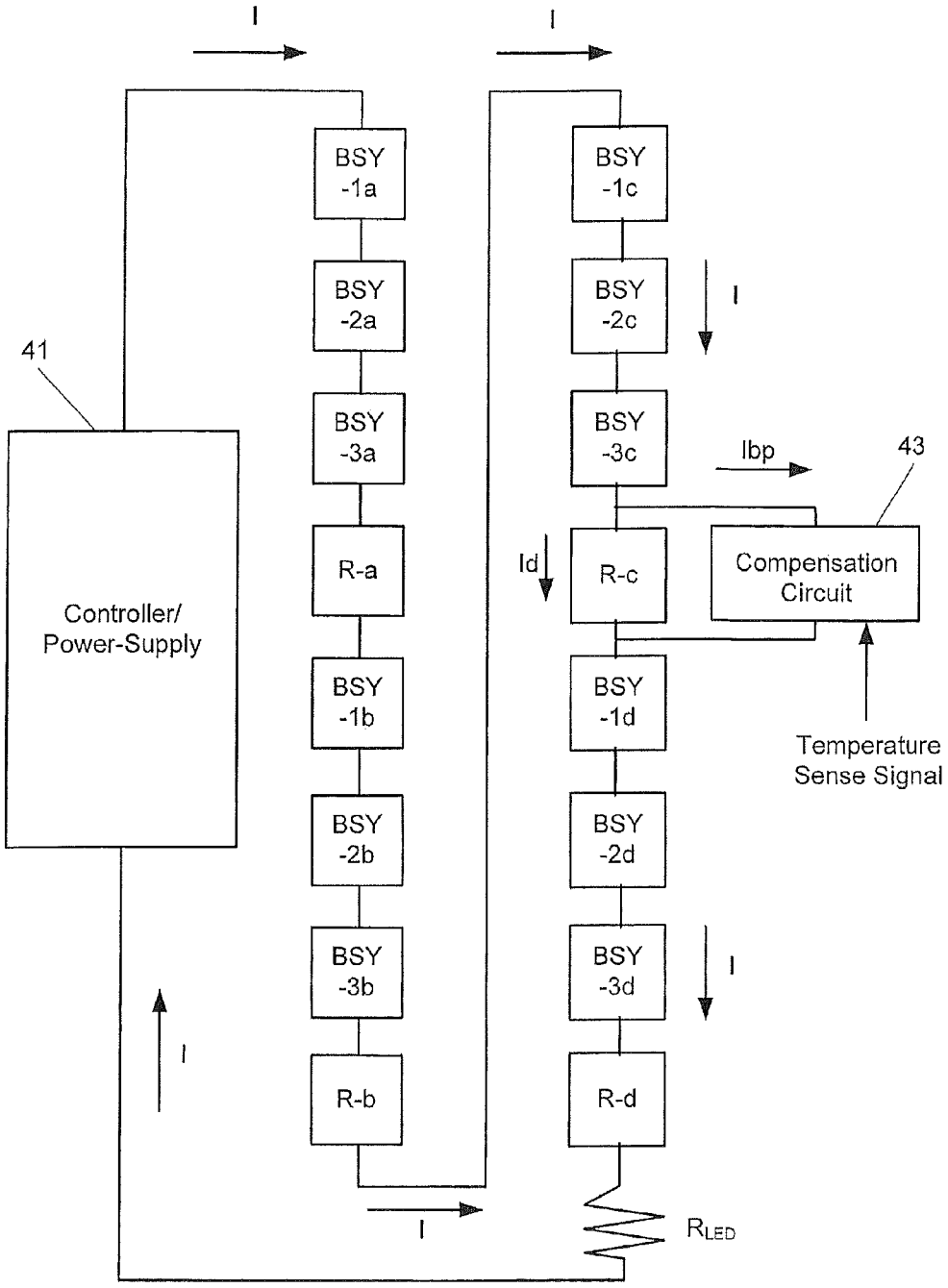
FIG. 4 is a schematic diagram illustrating electrical interconnections of elements of the lighting panel of FIGS. 2 and 3 according to some embodiments of the present inventive subject matter.

As shown in FIG. 4, blue-shifted-yellow and red light emitting devices BSY and R may be electrically coupled in series with controller/power-supply 41 and resistor $R_{LED}$ so that a same electrical current I flows through all of the light emitting devices BSY and R (with the exception of red light emitting device R-c as discussed in greater detail below) and resistor $R_{LED}$. By increasing the current I, to a maximum current (Imax), a brightest optical output 21 of lighting device 10 may be provided. By decreasing the current I generated by controller/power-supply 41, the optical output 21 of lighting device 10 may be dimmed. According to some embodiments, controller/power-supply 41 may provide output current I as a DC current that may be varied between 0 and Imax (e.g., responsive to a dimmer switch/slide/dial/etc. that is physically manipulated by a user) to provide variable brightness of optical output 21. By providing the light emitting devices BSY and R in series as shown in FIG. 4, lighting device 10 may be operated at a relatively high voltage with a single control current used to power all of the light emitting devices. By providing controller/power-supply 41 together with resistor $R_{LED}$, controller/power-supply 41 may effectively act as a current source.

Characteristics and numbers of light emitting devices BSY and R may be selected to provide desired characteristics (e.g., brightness, color, etc.) of optical output 21 at a given value of current I (e.g., at Imax) at a steady-state operating condition (e.g., at a steady-state operating temperature). For example, lighting device 10 may be configured to provide a specified optical output at a maximum operating current (I=Imax) after achieving a steady-state operating temperature. Optical output 21, however, may deviate from the specified optical output at lower currents (e.g., I<Imax, during dimming) and/or at lower temperatures (e.g., during warm up and/or during dimming) due to different output characteristics of the blue-shifted-yellow and red light emitting devices. At higher operating temperatures, for example, red light emitting devices R may be relatively less efficient than blue-shifted-yellow light emitting devices BSY, so that without compensation, a red component of optical output 21 may diminish relative to a blue-shifted-yellow component of optical output 21 at increased temperatures. At lower operating currents, blue-shifted-yellow light emitting devices may be more efficient than red light emitting devices, so that a blue-shifted-yellow component of optical output 21 may increase during dimming.

Accordingly, a compensation circuit 43 may be provided in parallel with red light emitting device R-c so that an electrical current Id through light emitting device R-c may be varied to compensate for the different operating characteristics (e.g., different responses to changes in temperature and/or current) of the blue-shifted-yellow and red light emitting devices to provide increased color uniformity of optical output 21. Compensation circuits and structures thereof are discussed, for example, in U.S. Publication No. 2011/0068702 entitled "Solid State Lighting Apparatus With Controllable Bypass Circuits And Methods Of Operation Thereof" and in U.S. Publication No. 2011/0068701 also entitled "Solid State Lighting Apparatus With Controllable Bypass Circuits And Methods Of Operation Thereof", the disclosures of which are hereby incorporated herein in their entireties by reference.

Compensation circuit 43 may thus be configured to vary a level of electrical current Id through light emitting device R-c (responsive to changes in temperature) relative to the current I through the other red light emitting devices R-a, R-b, and R-c and through the blue-shifted-yellow light emitting devices BSY. More particularly, compensation circuit 43 may be a bypass circuit that is configured to divert a bypass current Ibp from light emitting device R-c so that the current Id is less than or equal to the current I. Stated in other words, the current Id through light emitting device R-c is equal to the control current I minus the bypass current Ibp (i.e., Id=I−Ibp). By increasing the bypass current Ibp, the current Id through light emitting device R-c can be decreased relative to the current I through all of the other light emitting devices. Moreover, compensation circuit 43 may be configured to vary the bypass current Ibp responsive to the temperature sense signal generated by temperature sensor 31 as shown in FIGS. 3 and 4. Because the red light emitting devices R may be less efficient at higher operating temperatures, compensation circuit 43 may be configured to reduce Id (by increasing Ibp) at lower operating temperatures and to increase Id (by reducing Ibp) at higher operating temperatures.

According to some embodiments, compensation circuit 43 may be a pulse width modulated (PWM) bypass circuit providing a pulsed bypass current Ibp having a duty cycle that is controlled responsive to the temperature sense signal. Compensation circuit 43, for example, may increase bypass current Ipb by increasing a duty cycle of the bypass current thereby reducing current Id responsive to reduced temperatures, and compensation circuit 43 may reduce bypass current Ibp by reducing a duty cycle of the bypass current thereby increasing current Id responsive to increased temperatures. Current Id (or a component thereof) may be pulsed responsive to a pulsed bypass current Ibp so that a reduced current Id as used herein may refer to a reduced average current Is and so that an increased current Id may refer to an increased average current Id. According to other embodiments, compensation circuit 43 may be an analog bypass circuit including a transistor coupled in parallel with light emitting device R-c with a base/gate coupled to a bias circuit including a thermistor that is thermally coupled to one or more of light emitting devices BSY and/or R.

Compensation circuit 43 may thus be configured to provide Id at or near 100% of I when lighting device 10 is operating at full brightness (i.e., I=Imax) and at steady state operating temperature. Because lighting device 10 may be expected to operate most frequently at full brightness and because a highest electrical-to-optical conversion efficiency may be obtained when Ibp=0, numbers and sizes of light emitting devices BSY and R may be selected to provide a desired color/chromaticity of optical output 21 with I=Imax Id and with Ibp≈0 when operating at the expected steady state operating temperature. As discussed in greater detail below with respect to FIGS. 9A and 9B, light emitting devices BSY and R may be selected to provide a color point 911 having (u', v') color coordinates of about (0.260, 0.530) on black body curve 905 at about 2700 degrees K with I=Imax≈Id and with Ibp≈0 when operating at the expected steady state operating temperature. Because compensation circuit 43 may also be used to tune a color/chromaticity of optical output 21 during/after assembly to compensate for differences between expected and actual in blue-shifted-yellow and/or red light emitting device performances, a maximum current though light emitting device Id may be set to something less than 100% of Imax (e.g., 95% to 99% of Imax) when operating lighting device 10 at full brightness.

Figure 5:
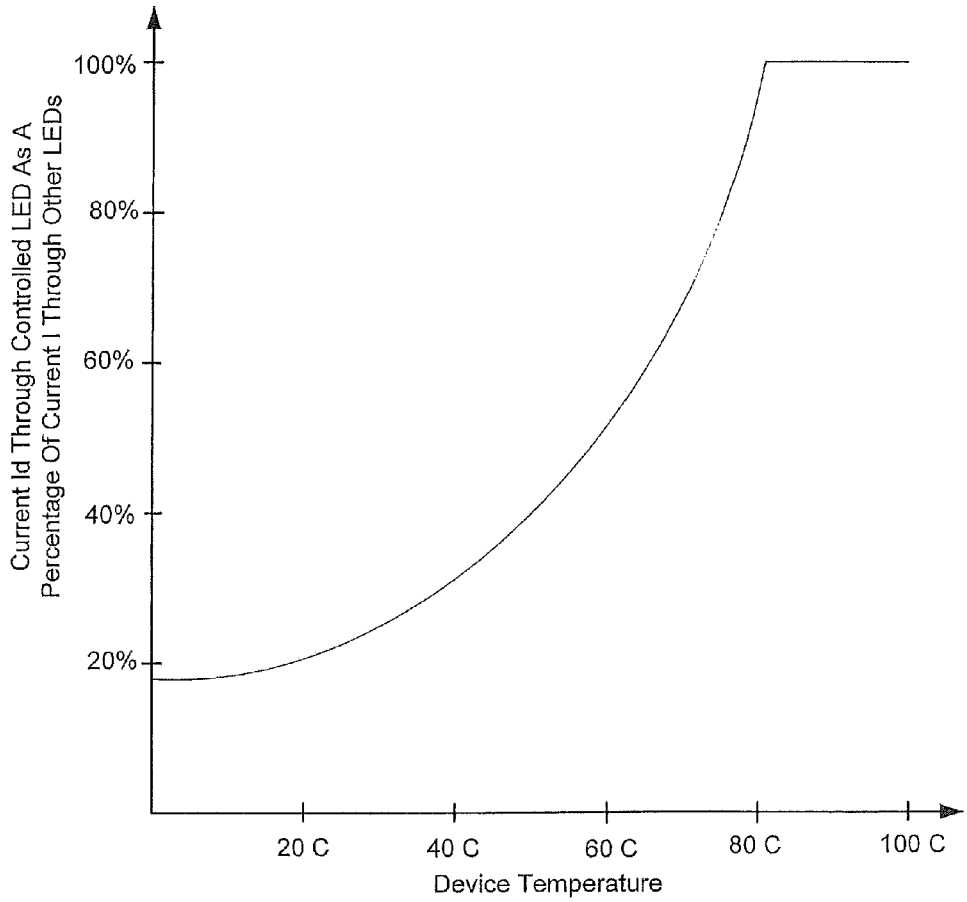
FIG. 5 is a graph illustrating operations of the compensation circuit of FIG. 4 according to some embodiments of the present inventive subject matter.

At temperatures less than the steady state full brightness operating temperature, compensation circuit 43 may increase the bypass current Ibp to reduce the current Id through light emitting device R-c. At reduced operating temperatures where the red light emitting devices R operate more efficiently relative to the blue-shifted-yellow light emitting devices BSY, a current Id through light emitting device R-c may be reduced relative to the current I through all of the other light emitting devices to provide increased uniformity of color of optical output 21 over a range of operating temperatures. By way of example, FIG. 5 is a graph illustrating the current Id through light emitting device R-c as a percentage of the current I through the other light emitting devices over a range of operating temperatures from less than room temperature (e.g., with room temperature at about 25 degrees C.) to greater than an expected maximum operating temperature (e.g., with a maximum operating temperature at about 80 degrees C.). Operating temperatures below the full brightness steady state operating temperature may occur during warm up when initially turned on and/or during dimming operations when the lighting device is operated as less than full brightness (I<Imax). As discussed in greater detail below with respect to FIGS. 9A and 9B, compensation circuit 43 may be configured to provide a color point 909 having (u', v') color coordinates of about (0.285, 0.530) below black body curve 905 with I<Imax when initially turned on at room temperature.

According to some embodiments, the compensation circuit 43 may be configured to provide that the level of electrical current Id through light emitting device R-c is at least ten percent of the electrical current I through the other light emitting devices over a range of operating temperatures including a lowest operating temperature of no more than about 25 degrees C., and/or over of operating temperatures including a lowest operating temperature of no more than about 20 degrees C. More particularly, the compensation circuit 43 may be configured to provide that the level of electrical current Id through light emitting device R-c is at least 25 percent or even 50 percent of the electrical current I through the other light emitting devices over a range of operating temperatures including a lowest operating temperature of no more than about 25 degrees C., and/or over of operating temperatures including a lowest operating temperature of no more than about 20 degrees C.

Figure 9A:
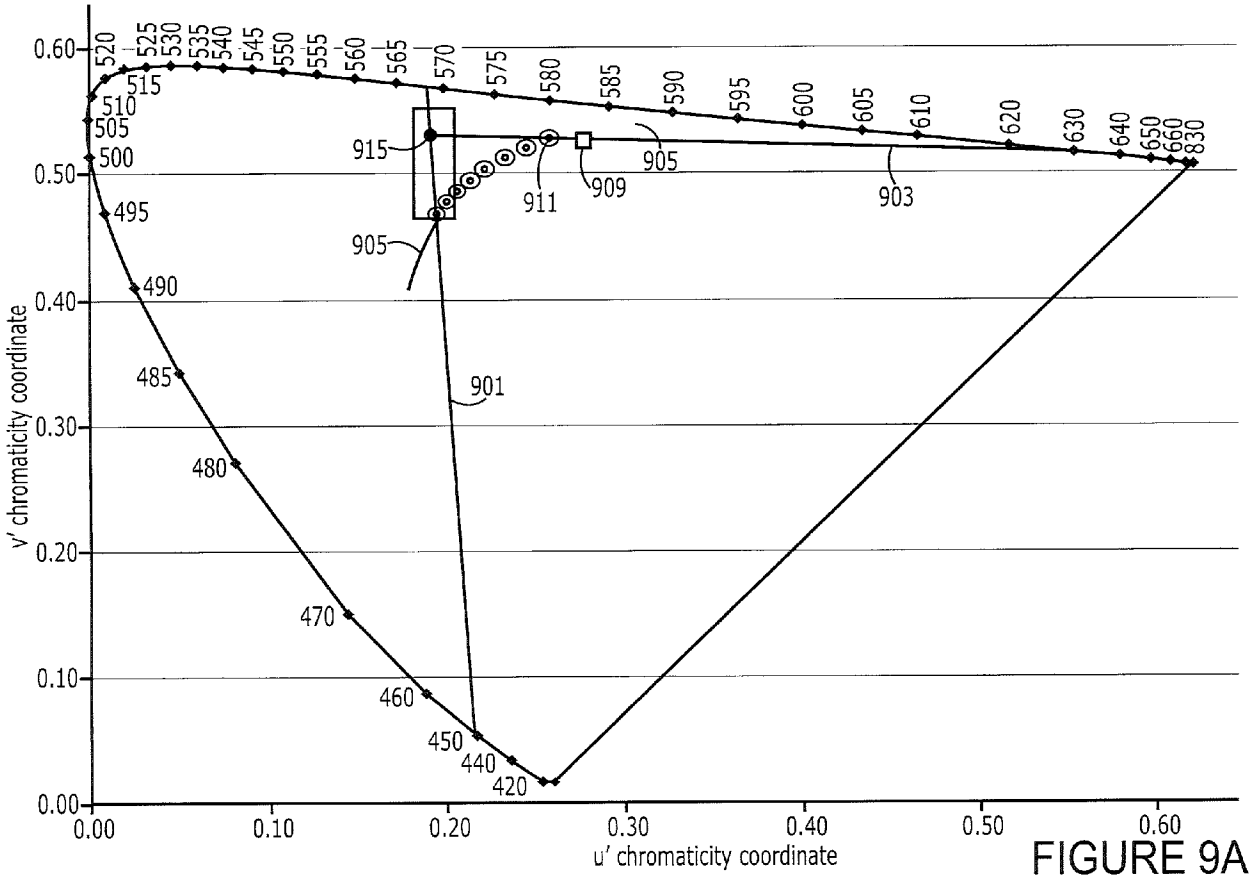
FIG. 9A is a u', v' chromaticity diagram illustrating ranges of chromaticities available using a blue-shifted-yellow light emitting device(s) and a red light emitting device(s) according to some embodiments of the present invention.
Figure 9B:
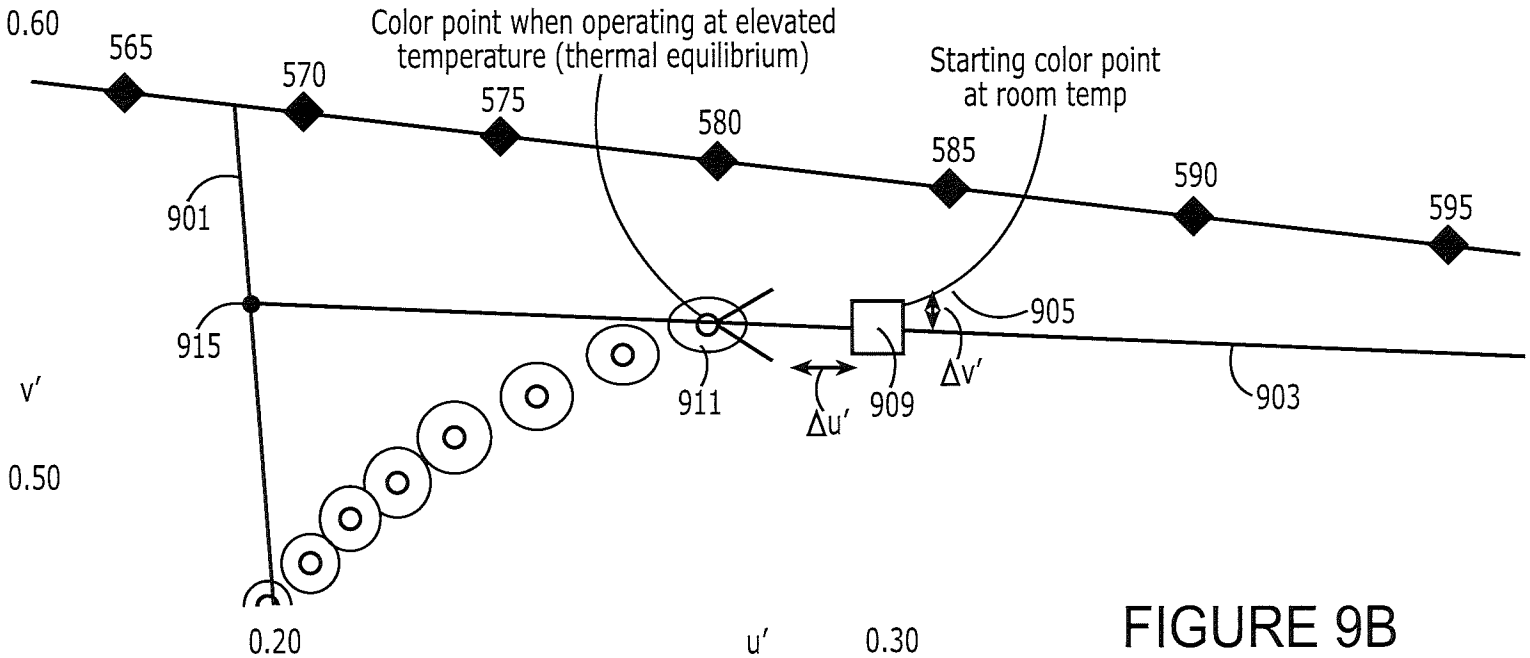
FIG. 9B is a greatly enlarged section of the chromaticity diagram of FIG. 9A.

Compensation circuit 43 may thus be configured to provide that light emitting device R-c emits at least some light over the range of operating temperatures including a lowest operating temperature of no more than about 25 degrees C. or even about 20 degrees C. When operating at room temperature when initially turned on, lighting device 10 may provide optical output 21 having color point 909 with (u', v') color coordinates of about (0.285, 0.530) below black body curve 905 as shown in FIGS. 9A and 9B which are discussed in greater detail below. As lighting device 10 warms up, a color of optical output 21 may move along line 903 from color point 909 at room temperature to color point 911 with (u', v') color coordinates of about (0.260, 0.530) at steady state full temperature operating temperature (also referred to as the thermal equilibrium temperature). Accordingly, a component of red in the overall optical output 21 may be increased when operating at room temperature when lighting device 10 is initially turned on (to provide an increased u' component, for example at color point 909) while a component of red in the overall optical output 21 may be reduced (to provide a reduced u' component, for example, at color point 911) when operating at steady state temperature. Lighting device 10, for example, may be configured to provide optical output 21 having a color point approximately on the black body curve (e.g., at a color temperature of about 2700 degrees K) at full brightness and steady state operating temperature, and to provide optical output 21 having a color output that is shifted away from the black body curve toward red (e.g., by a delta u' of at least 0.004, at least 0.005, or even at least 0.01) when at room temperature (e.g., when initially turned on).

To provide the desired color/chromaticity of the optical output 21 in a direct lighting application without significant diffusion and without maintaining an adequate balance of output from all of the red light emitting devices, however, an optical output of the compensating red light emitting device R-c may be reduced relative to the other red light emitting devices R-a, R-b, and R-c at lower operating temperatures to the extent that spatial non-uniformity of red in the optical output 21 may be visibly noticeable. A spot of blue/yellow may thus be visibly apparent in optical output 21 if an optical output of red light emitting device R-c is sufficiently reduced. Stated in other words, to maintain a constant average of red output to blue-shifted-yellow output over an entirety of optical output 21 by compensating/reducing the current of only one of the four red light emitting devices, a portion of optical output 21 may be noticeably lacking in red. By maintaining a sufficient output of the compensating red light emitting device R-c at lower temperatures as discussed above with respect to FIG. 5, spatial uniformity of color across optical output 21 may be improved at lower temperatures in direct lighting applications. While the resulting optical output 21 may have a warmer color (more red) at lower temperatures, this shift to red may be less noticeable than an alternative reduction in spatial color uniformity.

Figure 6A:
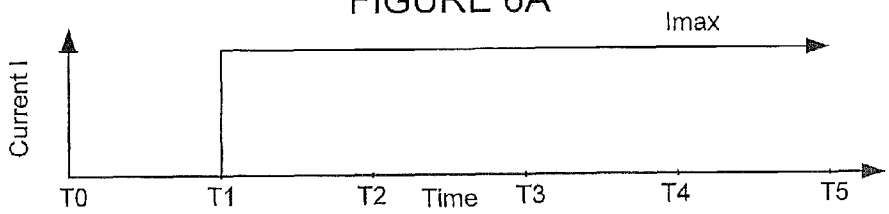
FIGS. 6A to 6E are graphs illustrating operations of the light emitting device of FIGS. 1-4 according to some embodiments of the present inventive subject matter.
Figure 6B:
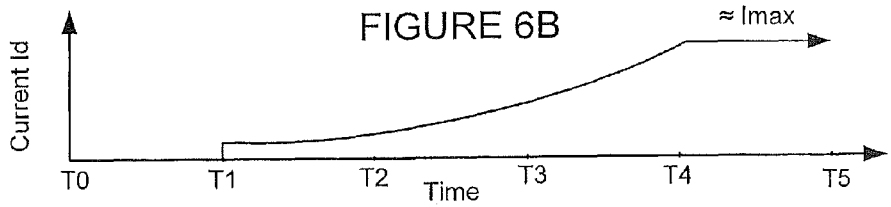
Figure 6C:
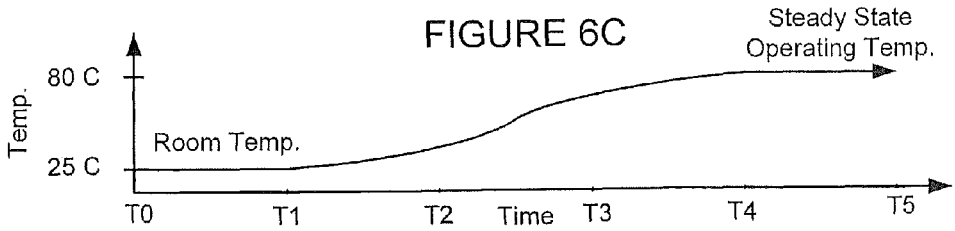
Figure 6D:
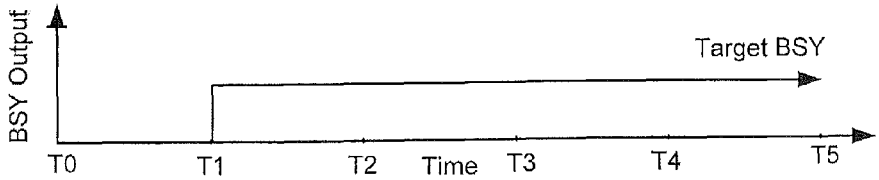
Figure 6E:
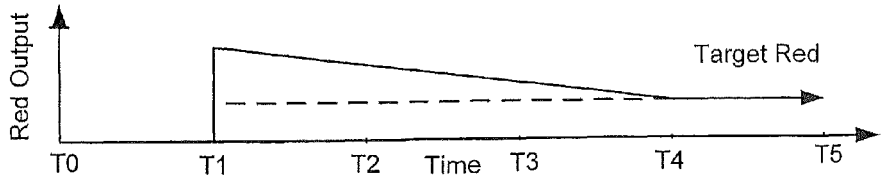

Examples of operations of lighting apparatus 10 (as shown in FIGS. 1-4) during warm up will now be discussed in greater detail below with reference to the graphs of FIGS. 6A to 6E. Prior to time T1, lighting apparatus 10 may be turned off with Current I and Current Id both at zero as shown in FIGS. 6A and 6B, and with lighting apparatus 10, lighting panel 20, and light emitting devices BSY and R at room temperature as shown in FIG. 6C. Accordingly, no light is generated by light emitting devices BSY and R as shown in FIGS. 6D and 6E prior to time T1. When lighting apparatus 10 is turned on at time T1 (without dimming), controller/power-supply 41 generates current I as shown in FIG. 6A, but compensation circuit 43 provides a compensated current Id through compensating light emitting device R-d responsive to the apparatus temperature illustrated in FIG. 6C. Compensation circuit 43, for example, may be configured to provide that current Id through compensation light emitting device R-c is at least 10% (or even 15% or 20%) of the current I through the other light emitting devices over the range of temperatures from room temperature (e.g., 25 degrees C. or 20 degrees C.) to steady state operating temperature (e.g., 80 degrees C. or 90 degrees C.). As discussed in greater detail below with respect to FIGS. 9A and 9B, at time T1, compensation circuit 43 may be configured to provide a color point 909 having (u', v') color coordinates of about (0.285, 0.530) below black body curve 905.

From time T1 to time T4, the lighting apparatus 10 warms up as shown in FIG. 6C (responsive to heat generated by the light emitting devices BSY and R), and the current I stays relatively constant at Imax while the current Id increases responsive to the increasing temperature. As discussed above, compensation circuit 43 may increase the current Id through light emitting device R-c responsive to the increasing temperature to compensate for diminished efficiency of the red light emitting devices at increased temperatures. Compensation circuit 43, however, may generate current Id at a level above that required to provide the targeted balance of red light relative to blue-shifted-yellow light during the warm up period between time T1 and time T4 as shown in FIG. 6E. As discussed above, at lower operating temperatures that may occur during warm up, compensated light emitting device R-c may be driven at a level beyond that required to provide the targeted steady state balance of BSY and red light in optical output 21 to increase a spatial uniformity of BSY and red light across optical output 21. As shown in FIGS. 9A and 9B, between times T1 and T4, compensation circuit 43 may be configured move optical output 21 along line 903 (below black body curve 905) between color point 909 and 911 having (u', v') color coordinates of about (0.260, 0.530).

At temperatures below the steady state operating temperature (e.g., from time T1 to T4), compensation circuit 43 may thus be configured to set a level of current Id through compensating light emitting device R-c that causes the combination of light emitted by light emitting devices BSY and R over optical output 21 to have a first dominant wavelength that is high relative to the targeted output (i.e., the optical output 21 is shifted toward red relative to the steady state target). Once the temperature reaches the steady state operating temperature (e.g., after time T4), compensation circuit 43 may be configured to set a level of current Id through compensating light emitting device R-c that causes the combination of light emitted by light emitting devices BSY and R over optical output 21 to have a second dominant wavelength of the targeted output that is less than the first dominant wavelength (i.e., the optical output 21 is shifted toward blue/yellow to provide the steady state output target). A spatial color uniformity of optical output 21 may thus be improved at lower temperatures by providing an average optical output 21 at lower temperatures that is redder than the optical output 21 targeted at the steady state operating temperature.

By way of example, compensation circuit 43 may be configured to provide current Id through light emitting device R-c in the range of about 10% to about 60% of the current I (or even in the range of about 15% to about 50% of the current I) through the other light emitting devices responsive to temperatures between about 20 degrees C. and about 65 degrees C. (or even in the range of about 25 degrees C. to about 50 degrees C.), during earlier portions of warm up. Compensation circuit 43 may be further configured to provide current Id through light emitting device R-c in the range of about 70% to about 100% of the current I (or even in the range of about 90% to about 100% of the current I) through the other light emitting devices responsive to temperatures between about 70 degrees C. to about 100 degrees C. (or even in the range of about 75 degrees C. to about 95 degrees C.). Moreover, compensation circuit 43 may be configured to maintain a shift in color of the combined optical output 21 of the light emitting devices BSY and R within about 0.005 delta in a u'v' chromaticity space over a range of operating temperatures from 30 degrees C. to 75 degrees C., and/or over a range of operating temperatures from 20 degrees C. to 85 degrees C. More particularly, compensation circuit 43 may be configured to provide a shift in color of the combined optical output 21 of the light emitting devices BSY and R (along line 903 between color points 909 and 911 of FIGS. 9A and 9B) within about 0.003 delta in a u'v' chromaticity space over a range of operating temperatures from 30 degrees C. to 75 degrees C., and/or over a range of operating temperatures from 20 degrees C. to 85 degrees C. In addition, the combined optical output 21 may fall within a ten-step MacAdam ellipse of a point on the black body planckian locus having a color temperature of about 2700 degrees K when the lighting apparatus is operated at full brightness (I=Imax) and steady state operating temperatures (e.g., at time>T4 in FIGS. 6A to 6E).

According to embodiments of the present inventive subject matter discussed above, compensation circuit 43 may provide aggregate balancing of blue-shifted-yellow and red light output from the plurality of light emitting devices of FIGS. 1-4 over a range of temperature and dimming conditions. In addition, compensation circuit 43 may be configured to increase color uniformity across a projected beam image of optical output 21 by providing a warmer/redder output color at lower temperatures than the target output color at the full brightness steady state operating temperature. Stated in other words, compensation circuit 43 may induce color imbalance (e.g., providing a warmer redder color) during warm up (i.e., at lower temperatures) to better maintain color uniformity across a projected beam image of optical output 21. When operating at full brightness and at the steady state operating temperature (with Id≈Imax, also referred to as the nominal operating temperature), lighting apparatus 10 may provide optical output 21 having a targeted color point on the black body curve (e.g., a targeted color point that is approximately white) at a color temperature of about 2700 degrees K. At lower operating temperatures, however, the increased percentage of red light in the optical output 21 may shift the color point off the black body curve (along line 905 of FIGS. 9A and 9B), but a spatial uniformity of color across optical output 21 may be improved.

The shift toward red at lower operating temperatures may be acceptable because the lower temperatures are expected to occur primarily during warm up when the lighting apparatus 10 is first turned on. Because warm up may occur quickly, the warmer/redder output may only occur for relatively short periods of time. Moreover, other lighting technologies (such as compact metal halide lights) may have dramatic color shifts during warm up to which consumers are accustomed.

During dimming operations, the shift toward red may actually (partially) offset a shift toward blue that may otherwise occur due to the relative increase in efficiency of blue light emitting devices (relative to red light emitting devices) at lower operating currents I.

In general, compensation circuit 43 may be configured to adjust an input current Id and output light of compensating red light emitting device R-c responsive (directly or indirectly) to a junction temperature of one or more of light emitting devices BSY and/or R. Because red light emitting devices R may be less efficient at higher temperatures, compensating red light emitting device R-c may be turned up to make up for the loss of red light at the higher temperatures. At lower temperatures, compensating red light emitting device R-c may be turned down to reduce red output as the red light emitting devices R become more efficient at lower temperatures. During dimming, however, current I is reduced, and blue-shifted-yellow light emitting devices BSY may be relatively more efficient at the lower currents. Turning down the compensating red light emitting device while the blue-shifted-yellow light emitting devices gain efficiency at lower currents may inadvertently result in an undesired shift toward yellow-green. According to embodiments discussed herein, maintaining a higher output of compensating red light emitting device R-c for spatial uniformity at lower temperatures may provide color balancing during dimming operations.

Moreover, consumers may be accustomed to a shift toward red during dimming operations because many conventional halogen and incandescent light sources shift toward red during dimming operations. Accordingly, a color shift toward red may be acceptable provided that the shift over the expected range of operating temperatures and currents (I) is not greater than about 0.007 delta u'v', and more particularly, if the color shift over the expected range of operating temperatures and currents (I) is not greater than about 0.005 delta u'v', and even more particularly, if the color shift over the expected range of operating temperatures and currents (I) is not greater than about 0.003 u'v'.

Embodiments of FIGS. 1-4 will now be discussed with reference to the chromaticity diagram of FIGS. 9A and 9B. Blue-shifted-yellow light emitting devices BSY may be provided using blue light emitting diodes emitting blue light having a wavelength of about 450 nm and a yellow phosphor that converts blue light to yellow light having a wavelength of about 568 nm. By controlling a quantity/thickness/density/etc. of yellow phosphor on each blue light emitting device, output of a BSY light emitting device may be provided along the BSY line 901 of FIGS. 9A and 9B. Red light emitting devices R may be provided using red light emitting devices emitting red light having a wavelength of about 630 nm. By configuring blue-shifted-yellow light emitting devices BSY to provide a color point 915 having (u', v') chromaticity coordinates of about (0.195, 0.530) and by configuring red light emitting devices R to provide red light having a wavelength of about 630 nm, an output of lighting device 10 may be varied along the line 903 of FIG. 9 that may cross the black body curve 905 at point 907 (e.g., at about 2700 degrees K) at (u', v') chromaticity coordinates of about (0.26, 0.53).

By way of example, compensation circuit 43 may be configured to provide a starting color point 909 at room temperature with (u', v') chromaticity coordinates of about (0.285, 0.530), and a steady state color point 911 at thermal equilibrium on the black body curve 905 with (u', v') chromaticity coordinates of about (0.260, 0.530). By controlling current through red light emitting device R-c using compensation circuit 43 as discussed above, a chromaticity of optical output 21 may be moved along line 903 between color point 909 (at time T1 as discussed above with respect to FIGS. 6A to 6E) and color point 911 (at times T4 and greater as discussed above with respect to FIGS. 6A to 6E).

As shown in FIGS. 9A and 9B, a color of optical output 21 may thus be designed to shift along line 903 from color point 909 (at room temperature when turned on) to color point 911 (at thermal equilibrium after having sufficient time to reach the steady state operating temperature at full brightness with I=Imax). As noted above an intentional color shift along line 903 may be induced to improve a spatial uniformity of color across optical output 21 over the range of operating temperatures. Stated in units of (u', v') chromaticity coordinates, a color of optical output 21 may be intentionally shifted over the range of operating temperatures by a delta u' of at least about 0.004, by a delta u' of at least about 0.005, or even by a delta u' of at least about 0.01. Moreover, the intentional shift over the full range of operating temperatures (between color points 909 and 911) may be maintained at a delta u' of no more than about 0.02, at a delta u' of no more than about 0.01, or even at a delta u' of no more than about 0.008. In addition, a delta v' between a color of optical output 21 over the range of operating temperatures (between color points 909 and 911) may be may be maintained at no more than about 0.015 over the full range of operating temperatures (between color points 909 and 911).

Figure 7:
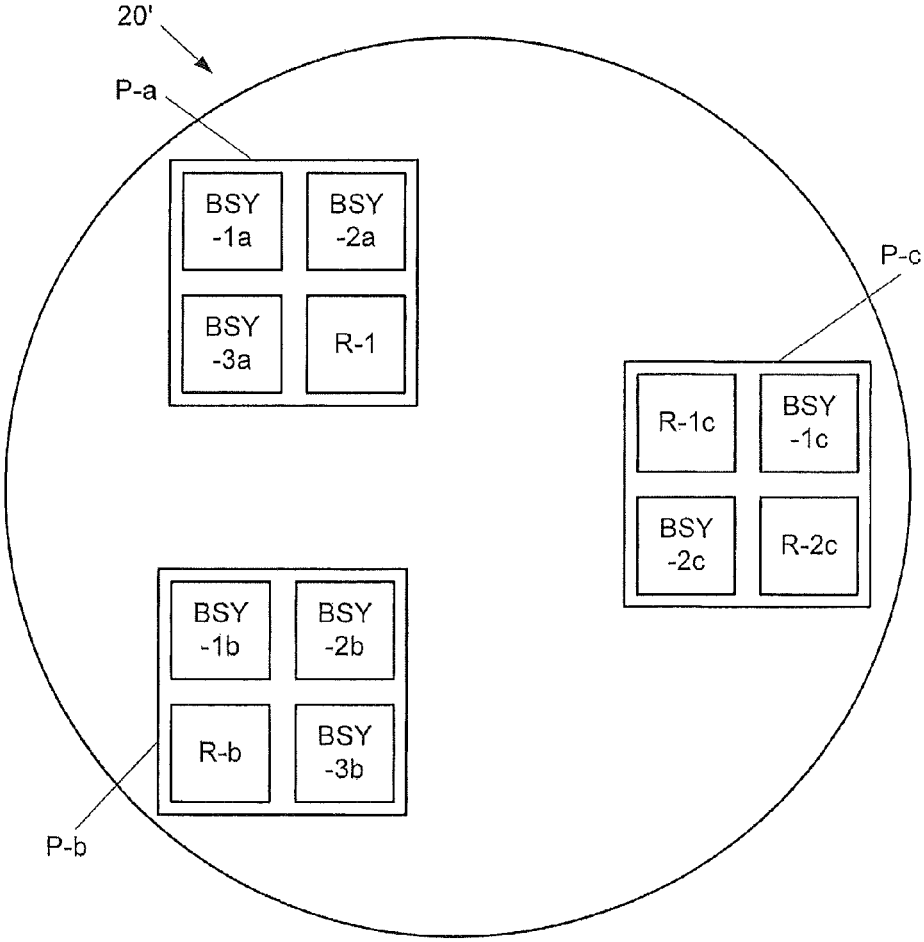
FIG. 7 is a plan view of a lighting panel including a plurality of light emitting devices according to some other embodiments of the present inventive subject matter.
Figure 8:
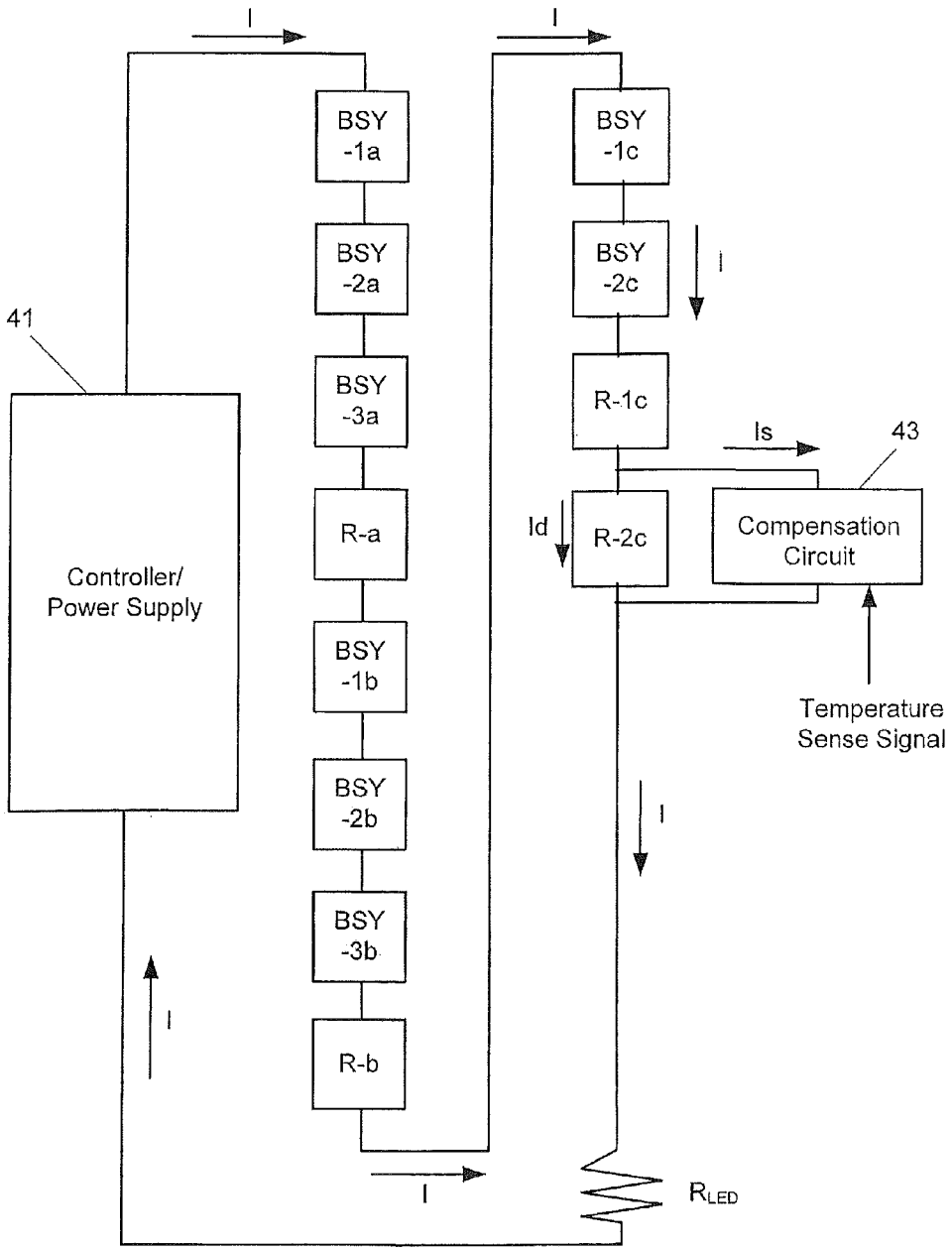
FIG. 8 is a schematic diagram illustrating electrical interconnections of elements of the lighting panel of FIG. 6.

While embodiments of the present subject matter have been discussed above by way of example with respect to particular structures of FIGS. 1-4, other structures may be used. FIGS. 7 and 8, for example, illustrate alternative structures including lighting panel 20' with 12 light emitting devices (BSY-1*a*, BSY-2*a*, BSY-3*a*, BSY-1*b*, BSY-2*b*, BSY-3*b*, BSY-1*c*, BSY-2*c*, R-a, R-b, R-1*c*, and R-2*c*) provided on three packaging substrates P-a, P-b, and P-c. Here the distribution of red and blue-shifted-yellow light emitting devices BSY and R is different to accommodate the lower number of light emitting devices. In FIG. 7, two red light emitting devices R-1*c* and R-2*c* are provided on packaging substrate P-c to maintain 4 red light emitting devices with one light emitting device provided in each of four packaging substrate quadrants. Operations of compensation circuit 43 of FIG. 8 may be substantially the same discussed above with respect to the structures of FIGS. 1-4. According to other embodiments, a third blue-shifted-yellow light emitting device may be provided on packaging substrate P-c in place of red light emitting device R-1*c* so that three blue-shifted-yellow light emitting devices BSY and one red light emitting device R are provided on each packaging substrate P.

In the drawings and specification, there have been disclosed embodiments of the present inventive subject matter and, although specific terms are used, they are used in a generic and descriptive sense only and not for purposes of limitation, the scope of the present inventive subject matter being set forth in the following claims.

That which is claimed is:

1. A lighting apparatus comprising:

a plurality of light emitting devices including a first light emitting device configured to emit light having a first chromaticity, a second light emitting device configured to emit light having a second chromaticity different than the first chromaticity, and a third light emitting device configured to emit light having the second chromaticity;

a temperature sensor configured to generate a temperature sense signal responsive to heat generated by at least one of the plurality of light emitting devices; and a compensation circuit coupled to the third light emitting device wherein the compensation circuit is configured to vary a level of electrical current through the third light emitting device relative to an electrical current through the first and second light emitting devices responsive to the temperature sense signal.

2. The lighting apparatus of claim 1 wherein the compensation circuit is configured to provide that the level of the electrical current though the third light emitting device is at least ten percent of the electrical current through the first and second light emitting devices over a range of operating temperatures including a lowest operating temperature of no more than about 25 degrees C.

3. The lighting apparatus of claim 1 wherein the compensation circuit is configured to provide the level of the electrical current through the third light emitting device at a first percentage of the electrical current through the first and second light emitting devices responsive to a first temperature sense signal representing a first temperature, wherein the compensation circuit is configured to provide the level of the electrical current through the third light emitting device at a second percentage of the electrical current through the first and second light emitting devices different that the first percentage responsive to a second temperature sense signal representing a second temperature different than the first temperature.

4. The lighting apparatus of claim 3 wherein the first temperature is less than the second temperature and wherein the first percentage is less than the second percentage.

5. The lighting apparatus of claim 3 wherein the first temperature is between about 20 degrees C. and about 45 degrees C., wherein the second temperature is between about 55 degrees C. and about 100 degrees C., wherein the first percentage is in the range of about 0 percent to about 60 percent of the of the electrical current through the first and second light emitting devices, and wherein the second percentage is in the range of about 40 percent to about 100 percent of the electrical current through the first and second light emitting devices.

6. The lighting apparatus of claim 1 wherein the first, second, and third light emitting devices are electrically coupled in series, wherein the compensation circuit comprises a bypass circuit electrically coupled in parallel with the third light emitting device, wherein the bypass circuit is configured to vary the level of electrical current through the third light emitting device by varying a bypass current diverted from the third light emitting device responsive to the temperature of the lighting apparatus.

7. The lighting apparatus of claim 6 wherein the bypass circuit comprises a pulse width modulation circuit configured to vary a duty cycle of the bypass current responsive to the temperature of the lighting apparatus.

8. The lighting apparatus of claim 1 wherein the first light emitting device comprises a blue-shifted-yellow light emitting device, and wherein the second and third light emitting devices comprise red light emitting devices.

9. The lighting apparatus of claim 1 further comprising:

a lighting panel with the plurality of light emitting devices oriented on the lighting panel; and a directed beam optic system spaced apart from the lighting panel, wherein the plurality of light emitting devices are oriented to emit light through the directed beam optic system to provide a Full-Width-at Half-Maximum opening cone angle of no more than about 60 degrees.

10. The lighting apparatus of claim 1 further comprising:

a lighting panel with the plurality of light emitting devices oriented on the lighting panel; and an optical diffuser spaced apart from the lighting panel, wherein the plurality of light emitting devices are oriented to emit light through the optical diffuser to provide a diffuse light output.

11. The lighting apparatus of claim 1 wherein the compensation circuit is configured to set the level of electrical current through the third light emitting device at a first level responsive to a first temperature that causes the combination of light emitted by the plurality of light emitting devices to have a first color point, and wherein the compensation circuit is configured to set the level of electrical current through the third light emitting device at a second level responsive to a second temperature that causes the combination of light emitted by the plurality of light emitting devices to have a second color point different than the first color point.

12. The lighting apparatus of claim 11 wherein the first temperature is less than the second temperature, and wherein the first color point is redder than the second color point.

13. A lighting apparatus comprising:

a plurality of light emitting devices including a first light emitting device configured to emit light having a first chromaticity and a second light emitting device configured to emit light having a second chromaticity different than the first chromaticity, wherein the plurality of light emitting devices are oriented to combine the light emitted thereby to provide a combined optical output;

a temperature sensor configured to generate a temperature sense signal responsive to heat generated by at least one of the plurality of light emitting devices; and a compensation circuit coupled to the second light emitting device, wherein the compensation circuit is configured to vary an electrical current passing through the second light emitting device responsive to the temperature sense signal, wherein the compensation circuit is configured to set a first level of current passing through the second light emitting device so that the combined optical output has a first color point responsive to a first temperature sense signal representing a first temperature, and wherein the compensation circuit is configured to set a second level of current passing through the second light emitting device different than the first level so that the combined optical output has a second color point different than the first color point responsive to a second temperature sense signal representing a second temperature greater than the first temperature wherein the first color point is redder than the second color point.

14. The lighting apparatus of claim 13 wherein the first light emitting device comprises a blue-shifted-yellow light emitting device and the second light emitting device comprises a red light emitting device.

15. The lighting apparatus of claim 13 wherein the compensation circuit is configured to cause the second light emitting device to emit at least some light having the second chromaticity over a range of operating temperatures including a lowest operating temperature of no more than about 25 degrees C.

16. The lighting apparatus of claim 13 further comprising:

a lighting panel with the plurality of light emitting devices oriented on the lighting panel; and a directed beam optic system spaced apart from the lighting panel, wherein the plurality of light emitting devices are oriented to emit light through the directed beam optic system to provide a Full-Width-at Half-Maximum opening cone angle of no more than about 60 degrees.

17. The lighting apparatus of claim 13 further comprising:

a lighting panel with the plurality of light emitting devices oriented on the lighting panel; and an optical diffuser spaced apart from the lighting panel, wherein the plurality of light emitting devices are oriented to emit light through the optical diffuser to provide a diffuse light output.

18. The lighting apparatus of claim 13 wherein the compensation circuit is configured to maintain a shift in color of the combined optical output of no more than about 0.007 delta in a u'v' chromaticity space over a range of operating temperatures from 30 degrees C. to 75 degrees C.

19. The lighting apparatus of claim 13 wherein combined optical output falls within a ten-step MacAdam ellipse of a point on the black body planckian locus when the lighting apparatus is operated at a full current steady state temperature.

20. The lighting apparatus of claim 13 wherein the plurality of light emitting devices comprises a third light emitting device having the second chromaticity, wherein the first, second, and third light emitting devices are electrically coupled in series, and wherein the compensation circuit is configured to vary a level of electrical current through the third light emitting device relative to the electrical current through the first and second light emitting devices responsive to the temperature sense signal.

21. The lighting apparatus of claim 20 wherein the compensation circuit is configured to provide that the level of the electrical current though the third light emitting device is at least ten percent of the electrical current through the first and second light emitting devices over a range of operating temperatures including a lowest operating temperature of no more than about 25 degrees C.

22. The lighting apparatus of claim 20 wherein the compensation circuit comprises a bypass circuit electrically coupled in parallel with the third light emitting device, wherein the bypass circuit is configured to vary the level of electrical current through the third light emitting device by varying a bypass current diverted from the third light emitting device responsive to the temperature sense signal.

23. The lighting apparatus of claim 22 wherein the bypass circuit comprises a pulse width modulation circuit configured to vary a duty cycle of the bypass current responsive to the temperature sense signal.

24. A method of operating a lighting apparatus including a plurality of light emitting devices including a first light emitting device configured to emit light having a first chromaticity, a second light emitting device configured to emit light having a second chromaticity different than the first chromaticity, and a third light emitting device configured to emit light having the second chromaticity, the method comprising:

varying a level of electrical current through the third light emitting device relative to the electrical current through the first and second light emitting devices responsive to a temperature of the lighting apparatus, wherein the first light emitting device is configured to emit light having the first chromaticity, and wherein the second and third light emitting devices are configured to emit light having the second chromaticity different than the first chromaticity.

25. The method of claim 24 wherein varying the level of electrical current comprises providing that the level of the electrical current though the third light emitting device is at least ten percent of the electrical current through the first and second light emitting devices over a range of operating temperatures including a lowest operating temperature of no more than about 25 degrees C.

26. A method of operating a lighting apparatus including a plurality of light emitting devices including a first light emitting device configured to emit light having a first chromaticity and a second light emitting device configured to emit light having a second chromaticity different than the first chromaticity, wherein the plurality of light emitting devices are oriented to combine the light emitted thereby to provide a combined optical output, the method comprising:

setting a first level of current passing through the second light emitting device so that the combined optical output has a first color point responsive to a first temperature of the lighting apparatus; and setting a second level of current passing through the second light emitting device different than the first level so that the combined optical output has a second color point responsive to a second temperature of the lighting apparatus greater than the first temperature, wherein the first color point is redder than the second color point.

27. The method of claim 26 further comprising:

maintaining at least some emission of light having the second chromaticity from the second light emitting device over a range of operating temperatures including a lowest operating temperature of no more than about 25 degrees C.

28. The method of claim 24 wherein varying the level of electrical current comprises providing the level of the electrical current through the third light emitting device at a first percentage of the electrical current through the first and second light emitting devices responsive to a first temperature of the lighting apparatus, and providing the level of the electrical current through the third light emitting device at a second percentage of the electrical current through the first and second light emitting devices different that the first percentage responsive to a second temperature of the lighting apparatus different than the first temperature.

29. The method of claim 28 wherein the first temperature of the lighting apparatus is less than the second temperature of the lighting apparatus and wherein the first percentage is less than the second percentage.

30. The method of claim 28 wherein the first temperature of the lighting apparatus is between about 20 degrees C. and about 45 degrees C., wherein the second temperature of the lighting apparatus is between about 55 degrees C. and about 100 degrees C., wherein the first percentage is in the range of about 0 percent to about 60 percent of the of the electrical current through the first and second light emitting devices, and wherein the second percentage is in the range of about 40 percent to about 100 percent of the electrical current through the first and second light emitting devices.

31. The method of claim 24 wherein varying the level of electrical current responsive to a temperature of the lighting apparatus comprises varying the level of electrical current responsive to a temperature sense signal generated by a temperature sensor responsive to heat generated by at least one of the plurality of light emitting devices.

32. The method of claim 26 wherein setting the first level of current comprises setting the first level of current passing through the second light emitting device responsive to a first temperature sense signal generated by a temperature sensor responsive to heat generated by at least one of the plurality of light emitting devices, and wherein setting the second level of current comprises setting the second level of current passing through the second light emitting device responsive to a second temperature sense signal generated by the temperature sensor responsive to heat generated by at least one of the plurality of light emitting devices.

* * * * *